US007487605B2

(12) United States Patent
Hatzilias

(10) Patent No.: US 7,487,605 B2
(45) Date of Patent: Feb. 10, 2009

(54) FOOTWEAR FOR GRIPPING AND KICKING A BALL

(75) Inventor: Konstantinos Hatzilias, Reservoir (AU)

(73) Assignee: Whiteheart Licensing Pty, Ltd., Reservoir (AU)

( * ) Notice: Subject to any disclaimer, the term of this patent is extended or adjusted under 35 U.S.C. 154(b) by 466 days.

(21) Appl. No.: 10/554,179

(22) PCT Filed: Apr. 21, 2004

(86) PCT No.: PCT/AU2004/000519

§ 371 (c)(1),
(2), (4) Date: Oct. 21, 2005

(87) PCT Pub. No.: WO2004/093588

PCT Pub. Date: Nov. 4, 2004

(65) Prior Publication Data

US 2006/0218821 A1 Oct. 5, 2006

(30) Foreign Application Priority Data

| | | |
|---|---|---|
| Apr. 22, 2003 | (AU) | 2003901919 |
| Jun. 24, 2003 | (AU) | 2003903225 |
| Sep. 4, 2003 | (AU) | 2003904825 |
| Dec. 4, 2003 | (AU) | 2003906732 |

(51) Int. Cl.

| | |
|---|---|
| ***A43B 23/20*** | (2006.01) |
| ***A43B 23/02*** | (2006.01) |
| ***A43B 5/02*** | (2006.01) |
| ***A43C 15/16*** | (2006.01) |

(52) U.S. Cl. ..... 36/133; 36/128; 36/45

(58) Field of Classification Search ..... 36/133, 36/128, 45, 77 R, 4 R, 59 R, 59 C; D2/955, D2/962

See application file for complete search history.

(56) References Cited

U.S. PATENT DOCUMENTS

D68,541 S * 10/1925 Packard (Continued)

FOREIGN PATENT DOCUMENTS

AU 650081 1/1993

(Continued)

OTHER PUBLICATIONS

International Preliminary Report on Patentability corresponding to International Application No. PCT/AU2004/000519, Issued Oct. 28, 2005, 5 pages.

(Continued)

*Primary Examiner*—Marie Patterson
(74) *Attorney, Agent, or Firm*—Hanley, Flight & Zimmerman, LLC

(57) ABSTRACT

A shoe upper (11) including one or more resiliently deformable protrusions (17, 19) extending from an outer surface of the shoe upper and positioned for contact with a ball, each said protrusion (17, 19) forming at least an inner contoured shape portion and an outer contoured shape portion, said outer contoured shape portion being deformable to promote engagement of said protrusion with said ball.

22 Claims, 17 Drawing Sheets

U.S. PATENT DOCUMENTS

| | | | | | |
|---|---|---|---|---|---|
| 1,559,450 | A | * | 10/1925 | Oakley | 36/59 C |
| 2,336,632 | A | * | 12/1943 | Park | 36/59 R |
| 2,383,117 | A | * | 8/1945 | Fellman | 36/59 C |
| D166,742 | S | * | 5/1952 | Fellman | D2/955 |
| 3,091,871 | A | * | 6/1963 | Tronche | 36/72 R |
| 3,191,321 | A | * | 6/1965 | Brutting | 36/133 |
| 4,000,566 | A | * | 1/1977 | Famolare, Jr. | 36/28 |
| 4,078,321 | A | * | 3/1978 | Famolare, Jr. | 36/3 B |
| 4,194,310 | A | * | 3/1980 | Bowerman | 36/128 |
| 4,447,971 | A | | 5/1984 | Bente | |
| 5,216,827 | A | | 6/1993 | Cohen | |
| D366,755 | S | * | 2/1996 | Abbey | D2/962 |
| 5,623,774 | A | * | 4/1997 | Abbey | 36/134 |
| D389,297 | S | * | 1/1998 | Adam | D2/962 |
| 5,737,858 | A | | 4/1998 | Levy | |
| 5,901,472 | A | * | 5/1999 | Adam | 36/134 |
| 5,926,980 | A | * | 7/1999 | Adam | 36/134 |
| 5,937,547 | A | * | 8/1999 | Abbey | 36/134 |
| D414,025 | S | * | 9/1999 | Adam | D2/962 |
| D430,723 | S | * | 9/2000 | Kim | D2/902 |
| 6,151,804 | A | | 11/2000 | Hieblinger | |
| 6,421,936 | B1 | | 7/2002 | Gerrand | |
| 6,523,282 | B1 | | 2/2003 | Johnston | |
| 6,544,626 | B1 | * | 4/2003 | Minges | 428/141 |
| 2003/0167658 | A1 | * | 9/2003 | Davis | 36/128 |
| 2004/0088888 | A1 | | 5/2004 | Johnston | |
| 2005/0081405 | A1 | * | 4/2005 | Healy | 36/59 C |
| 2006/0101669 | A1 | * | 5/2006 | Santos | 36/77 R |

FOREIGN PATENT DOCUMENTS

| | | | |
|---|---|---|---|
| AU | 25727/92 | | 4/1993 |
| AU | 48790/97 | | 5/1998 |
| AU | 751150 | | 6/1999 |
| AU | 2002217607 | | 7/2002 |
| GB | 202859 | | 8/1923 |
| GB | 2361406 | A | 10/2001 |
| JP | 8332101 | | 12/1996 |
| JP | 09028412 | | 2/1997 |
| RU | 2015675 | | 7/1994 |
| WO | WO 92/22224 | | 12/1992 |
| WO | WO 02/054898 | | 7/2002 |
| WO | WO 03/070039 | A1 | 8/2003 |

OTHER PUBLICATIONS

International Search Report from PCT Application PCT/AU2004/000519.

* cited by examiner

FIG. 6A
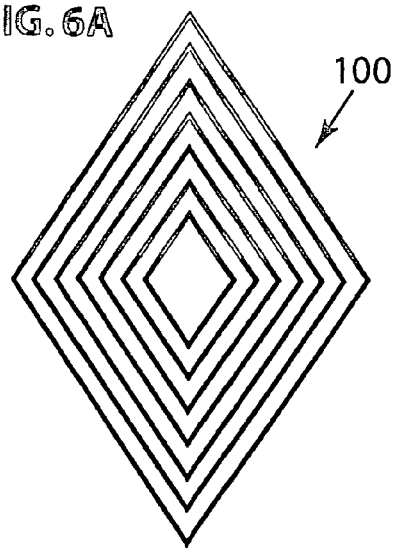
FIG. 6B
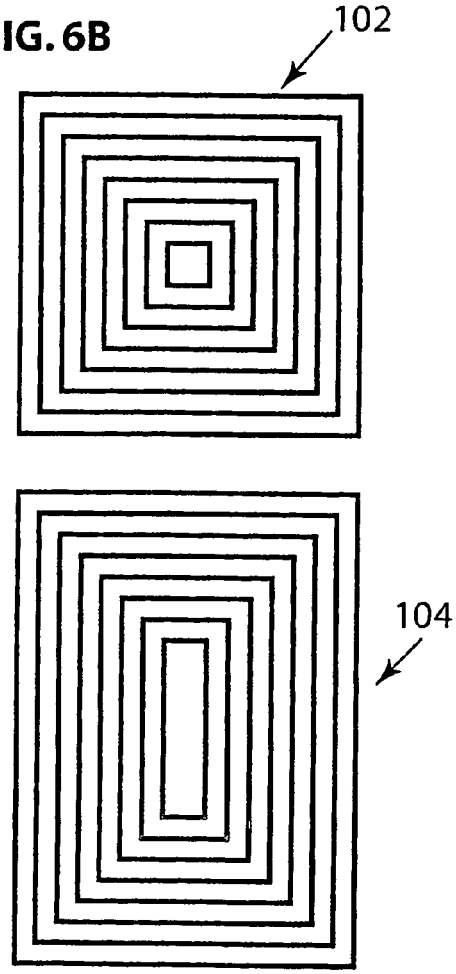
FIG. 6C
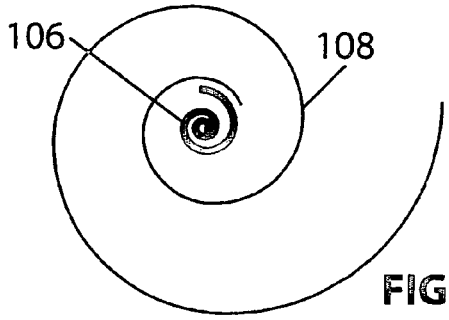
FIG. 6D
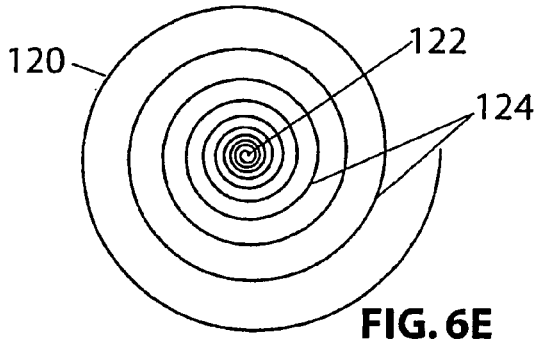
FIG. 6E
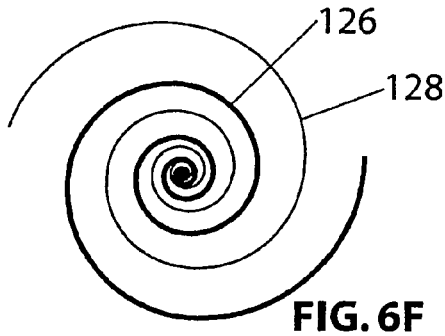
FIG. 6F
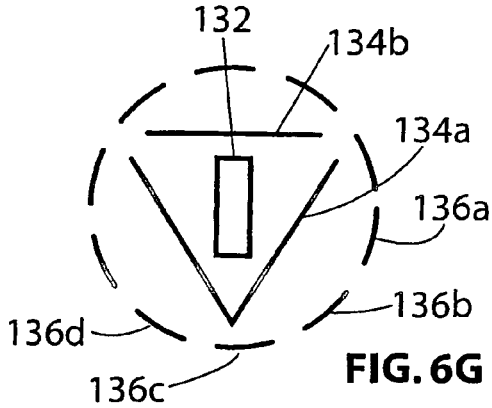
FIG. 6G FIG. 7A
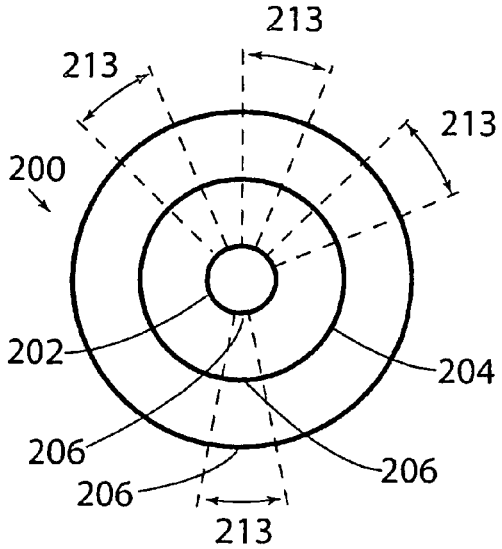
FIG. 7B
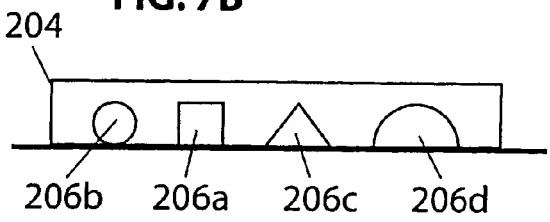
FIG. 7C
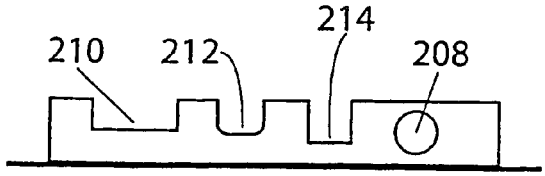
FIG. 7D
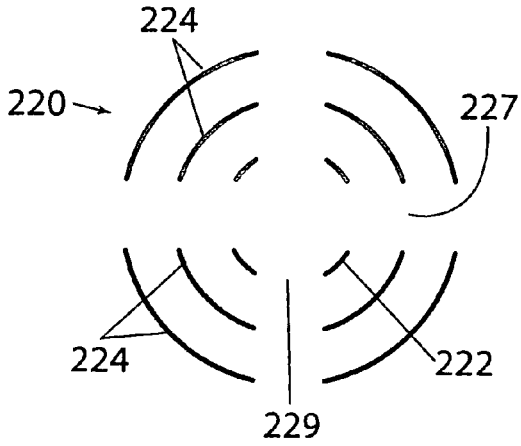
FIG. 7E
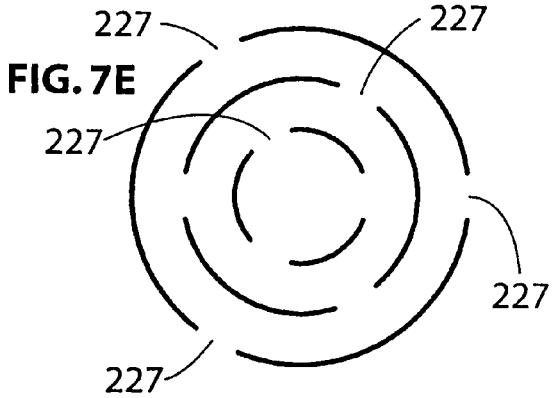
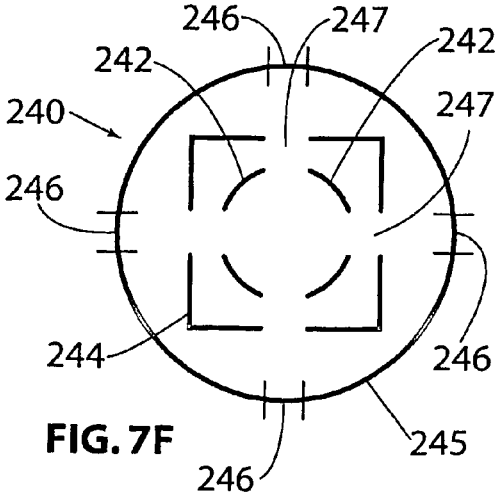
FIG. 7F

FOOTWEAR FOR GRIPPING AND KICKING A BALL

FIELD OF THE INVENTION

The present invention relates generally to athletic footwear. More particular, this invention relates to shoe uppers for athletic footwear used in football or other sports, which require kicking and/or dribbling of a ball with the player's feet. Throughout this specification the term "football shoe" will be used to refer to any type of footwear worn to play sports involving propulsion of a ball with a foot.

BACKGROUND OF THE INVENTION

Football shoes are used by a wearer to dribble, kick and pass a ball in various sports, such as football (soccer), Australian Rules, rugby league, and rugby union. In each of these sports, a player relies on being able to handle and control the ball with feet.

It is advantageous if a player's football shoes assist in handling and controlling the ball easily and effectively. For example, it is advantageous if a football shoe assists the player to achieve greater control, in that enhanced directional accuracy, curvature and power is provided to the ball as it is kicked. It is also advantageous if a football shoe is able to consistently confer such control in ordinary playing conditions, or is able to provide such control in adverse environmental conditions, such as in cold, wet and/or muddy environments.

There have been many attempts to incorporate into a football shoe some type of ball handling surface that provides the wearer with better grip and control of a ball. Usually, the ball handling surface comprises a series of raised projections covering the shoe to provide the greater frictional grip and therefore control of a ball.

GB 202859 discloses a shoe having an upper with a series of raised ribs e or projections f separated by grooves d. The ribs e and projections f do not adequately provide ball control in terms of directional accuracy, curvature and power when the ball is kicked.

SUMMARY OF THE INVENTION

It is an object of the invention to overcome the above described problem of the prior art or at least provide a unique and useful alternative to such ball control surfaces.

One aspect of the present invention provides a shoe upper for a shoe, including one or more resiliently deformable protrusions extending from an outer surface of the shoe upper and positioned for contact with a ball, each said protrusion forming at least an inner contoured shape portion and an outer contoured shape portion, said outer contoured shape portion being deformable to promote engagement of said protrusion with said ball.

The arrangement of an inner contoured shape portion and an outer contoured shape portion with the outer contoured shape portion being deformable stimulates ball feel and grip for a player, the shoe upper acting like a "sensory skin". Thus, a "glove" or "gloving" effect takes place, where pace is taken off the ball. It is believed that the ball is momentarily held or supported on the surface via the deformed outer contoured shape portion, before being assisted in its redirection by the outer contoured shape portion resiliently returning to its initial undeformed state. Furthermore, the arrangement of the contoured shape portions of the protrusion provides the shoe upper with multiple contact areas for the protrusion to engage the ball. Accordingly, a player wearing a shoe incorporating the shoe upper according to this aspect of the invention is provided with enhanced ball control and so is able to produce a variety of desired effects on the ball, such as greater curvature, improved directional accuracy and/or enhanced power when kicking the ball. These effects are produced with less effort required from the player. It also ensures a player can exercise greater control over the ball when dribbling or upon receipt of a pass from another player.

Preferably, the outer contoured shape portion is deformable radially relative to said inner contoured shape portion. The outer contoured shape portion may be deformable either radially inward or radially outward relative to the inner contoured shape portion.

It is particularly preferred that the outer contoured shape portion is deformable radially outward. The outer contoured shape portion is preferably inclined outward relative to said inner contoured shape portion to promote radially outward deformation. Preferably, there is a plurality of successive outer contoured shape portions, each of said successive contoured shape portions being bounded by the next successive contoured shape portion. In one preferred embodiment, each of the outer contoured shape portion forms an annular outer ring, each outer ring being bounded by the next successive ring.

Preferably the inner contoured shape portion and the outer contoured shape portion are generally concentric.

It is preferred that the inner contoured shape portion is also deformable. The inner contoured shape portion is preferably outwardly deformable. It is preferred that the inner contoured shape portion defines a ball contacting area of the shoe upper. The ball contacting area preferably corresponds to a sweet spot of the shoe upper.

The contoured shape portions are preferably selected from any one of circular, triangular, rectangular, ovoid, spiral, diamond, or other geometrical shapes. The contoured shape portions can form other shapes, such as semi-circular, "V"-like, flower-like, and even irregular shapes. The contoured shape portions may have the same shape within a protrusion. In a preferred embodiment, one or more contoured shape portions form a fingerprint-like pattern.

It is preferred that one or more of the contoured shape portions are formed as a continuous shape. Alternatively, one or more of the contoured shape portions can be formed as a broken outline of a shape. A broken outline of a shape can provide additional purchase on the ball.

Preferably, one or more of the contoured shape portions forming continuous shapes have one or more openings to permit debris to pass through. By providing these openings, debris such as dirt, mud, or water that may have been captured in the contoured shape portions can be allowed to escape, thus creating a self-cleaning mechanism and preventing the protrusions from becoming clogged in adverse weather or playing conditions. Preferably, one or more of the openings of said contoured shape portion are aligned with one or more openings of another contoured shape portions so as to form one or more channels to facilitate the passage of debris from the contoured shape portions. Alternatively, an opening of one contoured shape portion can be offset with respect to an opening of another contoured shape portion. The openings can be of any geometrical shape—polygonal, rectangular, circular, and the like. In a preferred embodiment, the openings have a semi-circular shape. The openings are preferably formed at the base of each contoured shape portion, although other locations of the openings in each contoured shape portion are possible. For example, the openings can be formed at the top of the contoured shape portions in the form of cut outs, such as slots.

Further advantages of providing these openings include the use of less material to make the contoured shape portions and thus reduced shoe weight (and so does not hinder a player's running speed), and the contoured shape portions being able to deform to a greater extent.

Similarly, where two or more of the contoured shape portions are formed into a broken outline of a shape, the gaps between the contoured shape portions in one broken outline can be aligned or offset with respect to the corresponding gaps between contoured shape portions of another broken outline. When the gaps are aligned, they preferably form channels to permit debris to pass through.

The inner contoured shape portion may be cylindrical, rectangular, or any other shape. In one embodiment, the inner contoured shape portion is a peg. The peg can be solid or can include an internal cavity. The cavity may be closed or open. The outer contoured shape portion or portions in this embodiment are preferably in the form of a ring or rings. The ring or rings may be a continuous shape or formed as a broken outline of a shape. In this particular embodiment, by making the inner contoured shape portion a solid peg, it provides additional control and power to redirecting the ball.

Generally, the inner and outer contoured shape portions are spaced apart from each other. However, in one embodiment, the inner and outer contoured shape portions are joined together to form inner and outer arcs of a continuous spiral.

The inner and outer contoured shape portions may have ball contacting surfaces which are roughened or patterned to further promote control of the ball. The ball contacting surface can have a step-like teeth pattern or wave-like pattern.

The inner and outer contoured shape portions may have a cross-sectional profile. The cross-sectional profiles preferably include a rectangular, sinusoidal, triangular, arcuate, or geometrical profile, or a combination of such profiles. A sinusoidal profile may form U-shaped troughs between the contoured shape portions while a triangular profile may form V-shaped troughs.

Various properties of the contoured shape portions may be altered to influence the degree of control over the ball and so produce different effects. Such properties that may be altered include, but are not limited to, their composition (rubber, carbon fibre, fabric, synthetic resin, plastic, etc), height, angle of inclination, and thickness. For example, the inner shape portion may be made of a different compound to the outer shape portion(s). The combination and various configurations of composition, height, angle of inclination, and thickness of the contoured shape portions influence various aspects of control, including grip, energy absorption, spin, and the capacity to generate greater power, swerve and accuracy when kicking. For example, to assist power kicking, some of the contoured shape portions may be less deformable, be thicker, or made of a harder compound to resist deformation upon impact with the ball. For dribbling, the contoured shape portions may be thinner, more deformable or be made of a more deformable compound so the player has a greater feel for the ball.

The properties of the contoured shape portions may be selected according to their respective locations in the protrusion. One or more of the protrusions may include a combination of contoured shape portions having different compositions, height, angle of inclination and thickness. In one embodiment, the composition of the contoured shape portions in the throat region of the shoe upper is such that these contoured shape portions are less deformable than the contoured shape portions which cover the lateral and medial regions of the shoe upper, the latter contoured shape portions having a different composition.

In addition, the spacing between the contoured shape portions may be varied to influence the degree of ball control as required, by either having the contoured shape portions loosely adjacent to each other, spaced quite far apart, or spaced apart at regular intervals from each other.

The contoured shape portions are generally formed from a single compound, such as rubber or suitable synthetic or plastic alternative.

Each protrusion preferably includes means for promoting deformation of said outer contoured shape portion upon contact with said ball. The use of a deformation promoting means enhances the "gloving effect" and so provides additional consistency, swerve, accuracy and power. The deformation promoting means also assists by providing the outer contoured shape portion with an increased "catapult" effect. That is, when the outer contoured shape portion comes into contact with the ball, the outer contoured shape portion deforms to a greater extent due to the deformation promoting means and so permit the outer contoured shape portion to apply more force to the ball when it is redirected as the outer contoured shape portion returns to its undeformed state.

Where the inner contoured shape portion is deformable, it may also include a deformation promoting means.

Preferably, the deformation promoting means includes a groove adjacent to each said contoured shape portion to increase the extent to which said contoured shape portion can deform. In one embodiment, the groove extends parallel to the length of the contoured shape portion.

The deformation promoting means preferably includes a means for supporting each said contoured shape portion during deformation. The supporting means may include a spring-like mechanism. Preferably, the supporting means includes a pad to brace the contoured shape portion. In one embodiment, the pad is located within the groove. The pad may be longitudinal in extent and be parallel to the contoured shape portion. The pad may be made of a deformably resilient material, such as rubber. The pad may also include an internal cavity to contain a resilient material, such as a gel, liquid, or gas, including air.

Preferably, each said contoured shape portion includes a resilient strip for contact with the ball.

It is also preferred that the invention provides a plurality of resiliently deformable bar-like members extending from the outer surface of the shoe upper for contact with the ball. Each bar-like member may also include means for promoting deformation of said bar-like member upon engagement with the ball. The provision of bar-like member increases the strength of kicks.

Preferably, one or more of the contoured shape portions are removably attachable to the shoe upper. It is also preferred that one or more of the contoured shape portions can be fixed to a mounting surface, the mounting being removably attachable to the shoe upper.

One or more of the protrusions are preferably removably attachable to the shoe upper. One or more of the protrusions may be fixed on a mounting surface, the mounting surface being removably attachable to the shoe upper.

Alternatively, one or more of the contoured shape portions, the protrusions, the mounting surface or a combination of all three can be integrally formed with the shoe upper.

Another aspect of the present invention provides a kit for a shoe upper, said kit including one or more resiliently deformable protrusions, each having a mounting surface for removably attaching said protrusions to said shoe upper so that said one or more protrusions extend from an outer surface of the shoe upper and are positioned for contact with a ball, each said protrusion forming at least an inner contoured shape portion and an outer contoured shape portion, said outer contoured shape portion being deformable to promote engagement of said protrusion with said ball.

By providing a kit according to this aspect, the invention can be retrofitted to existing shoes with ease.

The mounting surface may be removably attached to the shoe upper using one or more fasteners. Fasteners may include snaps, hook and pile fasteners and the like.

It is an object of preferred embodiments of the present invention to provide a shoe upper that gives greater control, (ie. enhanced directional accuracy, curvature, consistency and power), or at least provide a useful alternative to other known ball control surface arrangements in athletic footwear.

BRIEF DESCRIPTIONS OF THE DRAWINGS

Preferred embodiments of the present invention will now be described, by way of example only, with reference to the accompanying drawings, as set out below.

FIGS. 6A-6M are top views of alternative shapes of the contoured shape portions.

FIGS. 7A-7F are top and side views of other preferred embodiments of the invention.

DETAILED DESCRIPTION OF THE PREFERRED EMBODIMENTS

Figure 1:
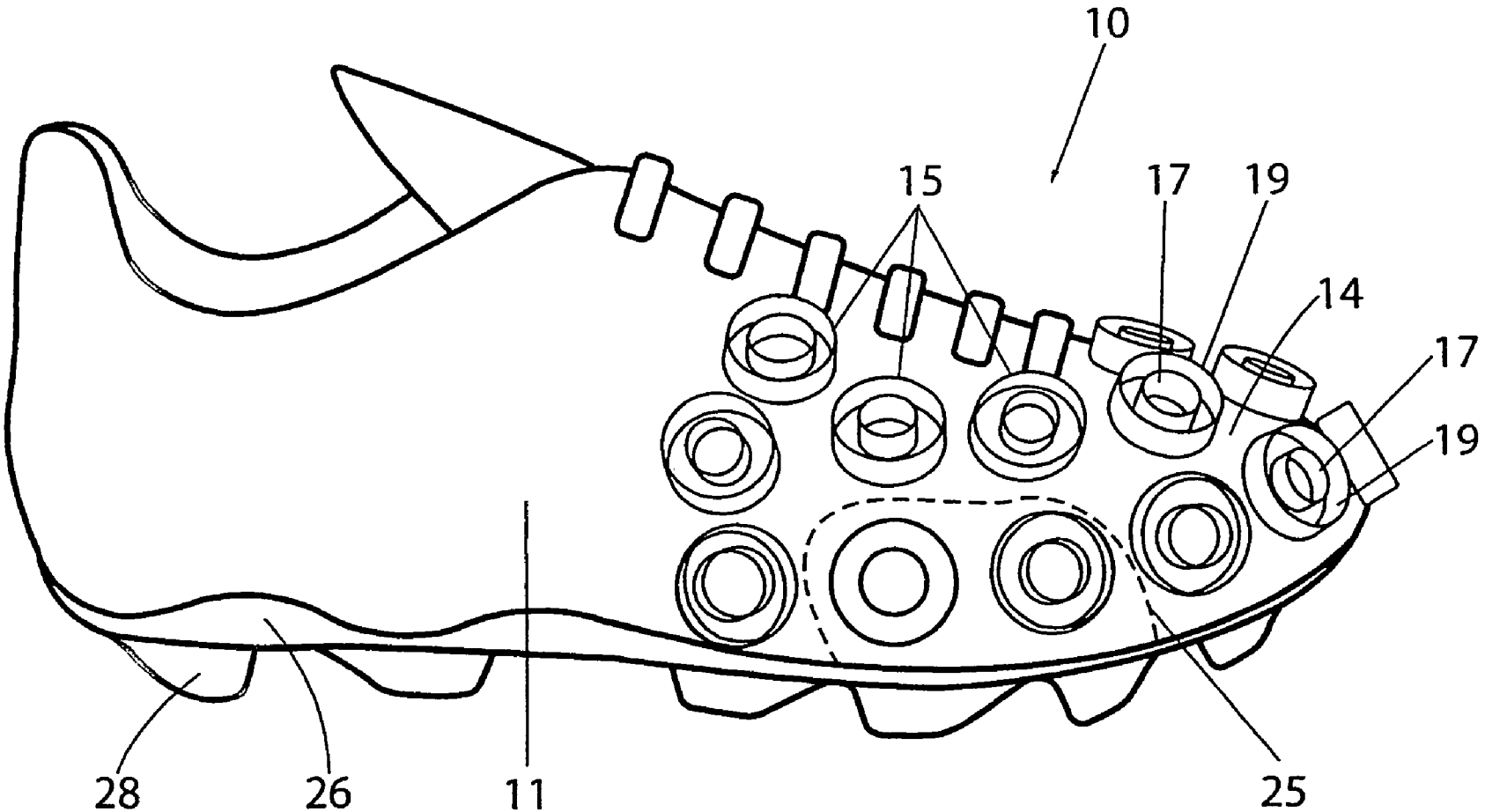
FIG. 1 is a side view of a sports shoe according to one embodiment of the present invention.

Preferred embodiments of the present invention will now be described with reference to the figures where like reference numbers indicate identical or functionally similar elements. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can be employed in a variety of other applications.

A football shoe 10 in accordance with a preferred embodiment of the present invention is shown in FIG. 4. The shoe 10 has an upper 11 whose outer surface includes a ball control region 14 with resiliently deformable protrusions 15, each protrusion 15 including contoured shape portions. The contoured shape portions include an inner ring 17 bounded by an outer ring 19.

Figure 2A:
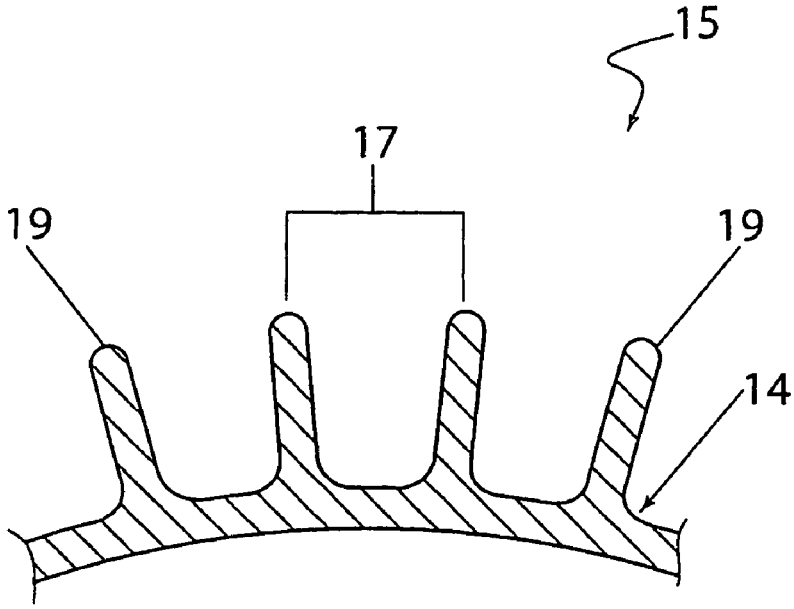
FIG. 2A is a cross-sectional view of the contoured shape portions of FIG. 1 in an initial state.

The outer rings 19 can be spaced apart from inner ring 17 at different distances for each protrusion 15. As can be seen more clearly in FIG. 2B, the outer ring 19 is outwardly deformable relative to the inner ring 17 when each protrusion 15 comes into contact with a ball 20. The outward deformability of outer ring 19 stimulates the grip and feel of the ball is on shoe 10 for a player, acting like a sensory skin and producing a gloving effect; that is, the ball is momentarily supported on deformed outer ring 19 before being assisted in its redirection by outer ring 19 returning to its undeformed state, as seen in FIG. 2A. This allows a player wearing shoe 10 to exert more control of a ball. For example, a player can impart more spin to the ball, resulting in greater swerving of the ball.

Figure 2B:
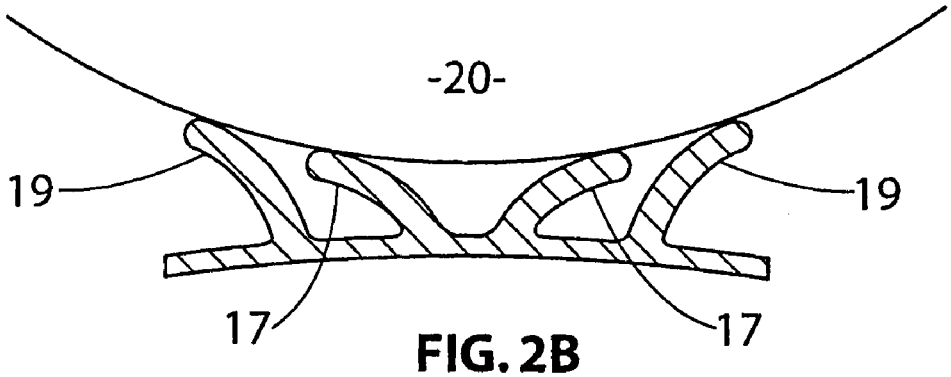
FIG. 2B is a cross-sectional view of the contoured shape portions of FIG. 1 in a deformed state in contact with a ball.
Figure 2C:
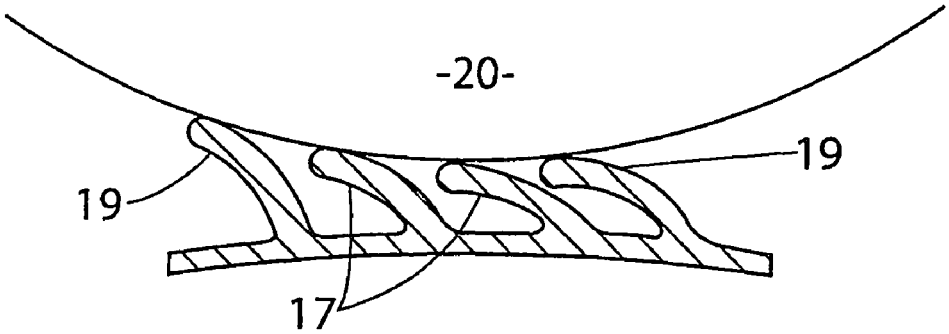
FIG. 2C is a cross-sectional view of an alternative embodiment of the contoured shape portions of FIG. 1 in a deformed state.

In this particular embodiment, inner ring 17 is also outwardly deformable as seen in FIG. 2B. This provides additional grip and feel. However, the inner ring 17 need not be deformable, or as deformable as the outer ring 19, and can be more resilient to assist in increasing the force applied to the ball. In an alternative embodiment as shown in FIG. 2C, the inner ring 17 may deform in parallel with outer ring 19 while providing the same gloving effect as in FIG. 2B.

Figure 3:
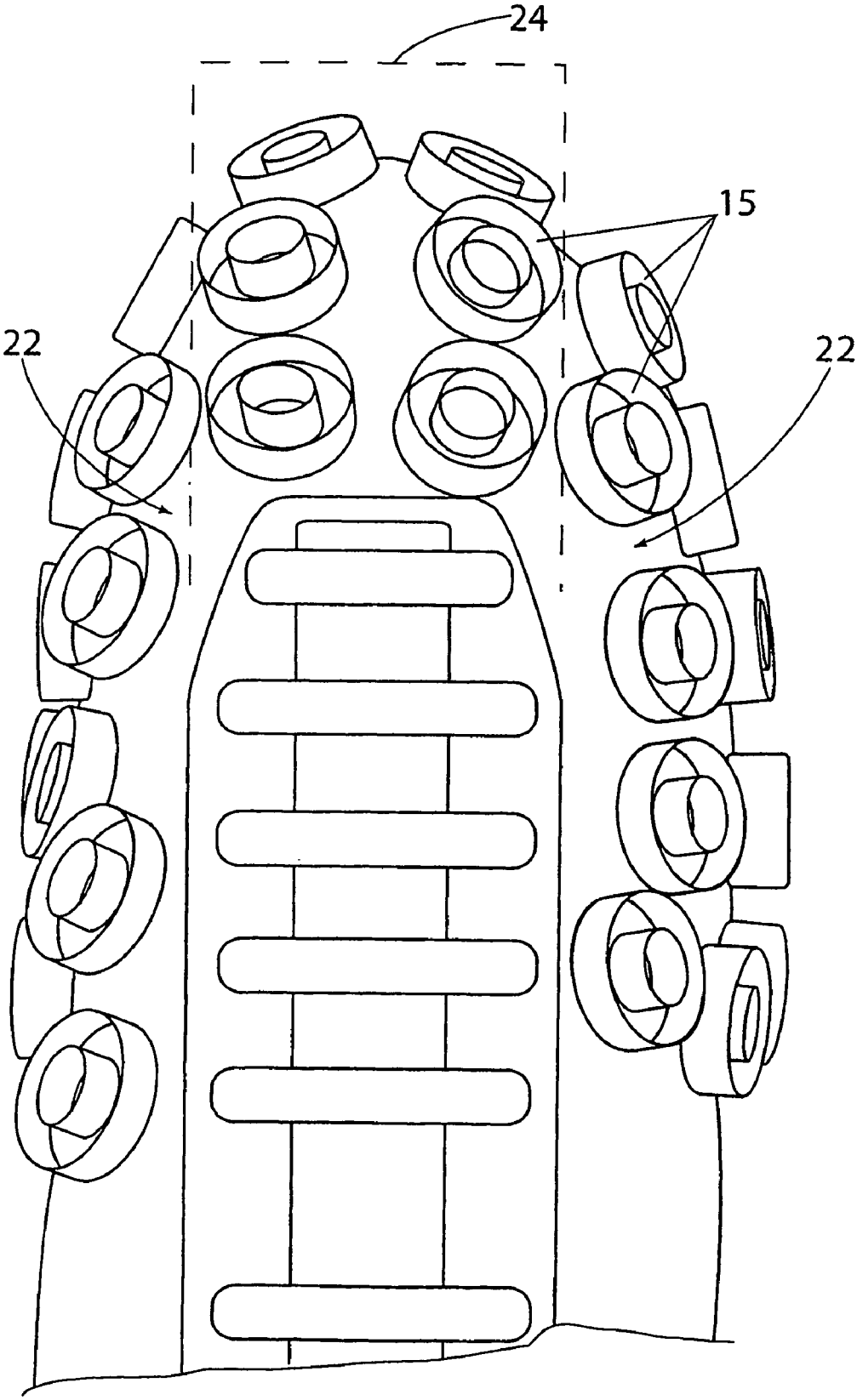
FIG. 3 is a partial top view of the shoe of FIG. 1.

The protrusions 15 formed by inner ring 17 and outer rings 19 are arranged in a particular area of the upper 11, such as the common regions where a ball is kicked or controlled. For example, as seen in FIG. 3, protrusions 15 are arranged on the lateral regions 22 (both sides of the front of shoe 10) and the medial region 24.

The ball control region 14 can be anywhere on the outer surface of upper 11 as required, including the heel area. For example, region 14 may correspond to a "sweet spot" area 25 as shown in dotted lines in FIG. 1 for contact with the ball so as to maximise control, power and feel of the ball.

FIGS. 2A and 2B illustrate how the first embodiment of the invention works. FIG. 2A shows the protrusions 15 in their initial undeformed state with inner ring 17 and the outer ring 19. The resiliently deformable protrusions 15 are able to store and release energy so that when they are deformed upon contact with a ball (FIG. 2B), energy is stored and then transferred to the ball as the protrusions 15 return to their undeformed state when the ball is released. When a ball 20 contacts region 14, the inner ring 17 and outer ring 19 deform or "flatten" outwardly to produce a glove effect where the ball is temporarily supported by the deformed rings 17, 19, thus providing greater feel of the ball to the player and allowing for greater control of the ball. When a player applies a force to redirect and generates the desired control effect on the ball, the rings 17, 19 assist in applying additional force to the ball 20 by returning to their undeformed state (FIG. 2A) and transferring the energy stored upon deformation to the ball 20.

Thus, in this embodiment by forming the protrusions 15 on upper 11 with at least an inner contoured ring 17 and outer contoured ring 19 which is deformable relative to inner ring 17, the protrusions 15 confer a player wearing shoe 10 with greater feel and grip of the ball, who is therefore able to control the ball more effectively. While this embodiment has been described with an inner contoured ring 17 and an outer contoured rings 19 deforming radially outward, the invention and this embodiment may have arrangements where the outer ring 19 deforms radially inward relative to the inner ring 17, only the outer ring 19 deforms, the inner ring 17 and the outer ring 19 deform in the same direction (as shown in FIG. 2C), or the inner ring 17 and the outer ring 19 deform in opposing directions (including towards each other), and still confer the advantage of a gloving effect.

The rings 17, 19 generally have a uniform cross-sectional profile of substantially equal height and width. The rings 17, 19 may be up to approximately 10 mm in height and preferably in the range of approximately 2-8 mm in height. Thinner contoured shape portions, are generally more deformable.

In addition, the outer ring 19 may be inclined outwardly with respect to the inner ring 17 to further promote outward deformation.

Upper 11 is preferably made of leather, any suitable synthetic and/or lightweight material, including rubber, polyurethane, carbon fibre or any suitable combination. The ball control region 14 may be formed integrally with upper 11 or be attached or bonded to upper 11. The sole 26 and studs 28 are integrally formed from plastic, usually by way of an injection molding process. Alternatively, the sole 26 and studs 28 may be formed separately and attached to one another in any means apparent to a person skilled in the art. Alternatively, upper 11 (with ball control region 14) can be integrally formed with sole 26, which can be done by an injection moulding process.

Figure 4A:
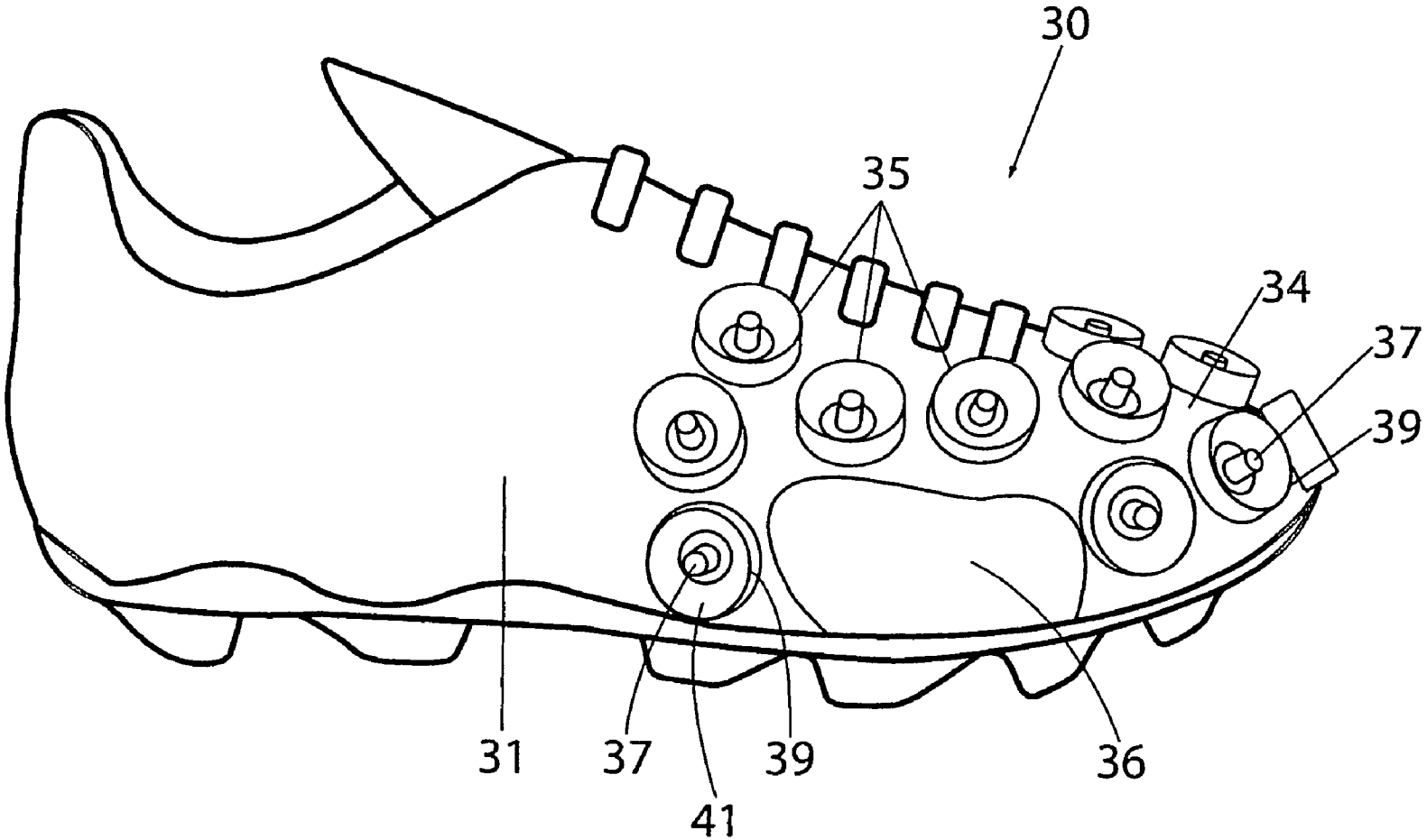
FIG. 4A is a side view of a sports shoe according to a second embodiment of the present invention.

FIG. 4A shows a second embodiment of the invention. The shoe 30 has upper 31 with a ball control region 34 including protrusions 35 exposing a "sweet spot" 36. This promotes ball contact with both protrusions 35 and sweet spot 36. The protrusions 35 are formed by contoured shape portions 37, 39. The inner contoured shape portion 37 is a cylindrical peg, while outer contoured shape portion 39 is an annular ring surrounding peg 37. The protrusions 35 formed by the peg 37 and ring 39 are formed over ball control region 34 of upper 31. The peg 37 is solid and so is more resilient and less deformable than ring 39. Outer ring 39 has an inner surface 41 that is inclined or bevelled to facilitate ring 39 deforming outwardly relative to peg 37. The greater resilience of peg 37 provides a greater directional control and more force to the ball on contact, thus increasing the kicking power of the shoe 30. The ring 39, being more deformable, provides grip and feel of the ball to the player and thus enhances more finesse skills, such as dribbling, imparting spin, improved accuracy and other aspects of ball control.

Successive outer rings like ring 39 can be added, each successive outer ring surrounding the previous ring. The wall thickness for ring 39 may be less than the thickness of peg 37 and/or can be made of a more deformable material. Outer ring 39 need not have inclined inner surface 41, but can be inclined outward to promote radially outward deformation.

Figure 4B:
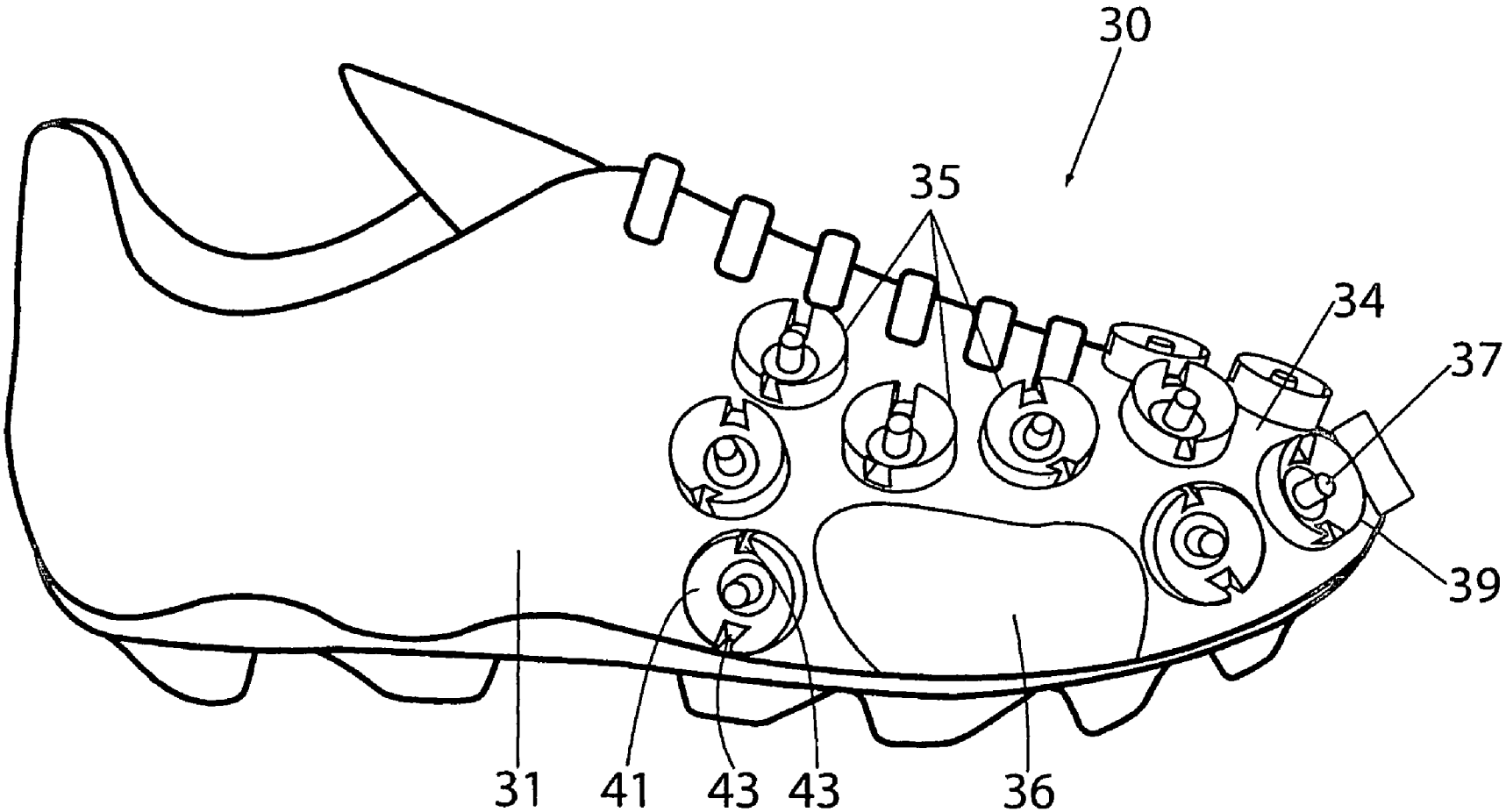
FIG. 4B is a side view of a variation of the shoe of FIG. 4A.

FIG. 4B shows a variation of the second embodiment where outer ring 39 has two opposed cut out portions in the form of slots 43 to divide outer ring 39 into two halves. The slots 43 provide outer ring 39 of this embodiment with greater deformability than ring 39 of FIG. 4A. Slots 43 also provide a self-cleaning system, which is described with respect to FIGS. 7A-7F in more detail below.

Figure 4C:
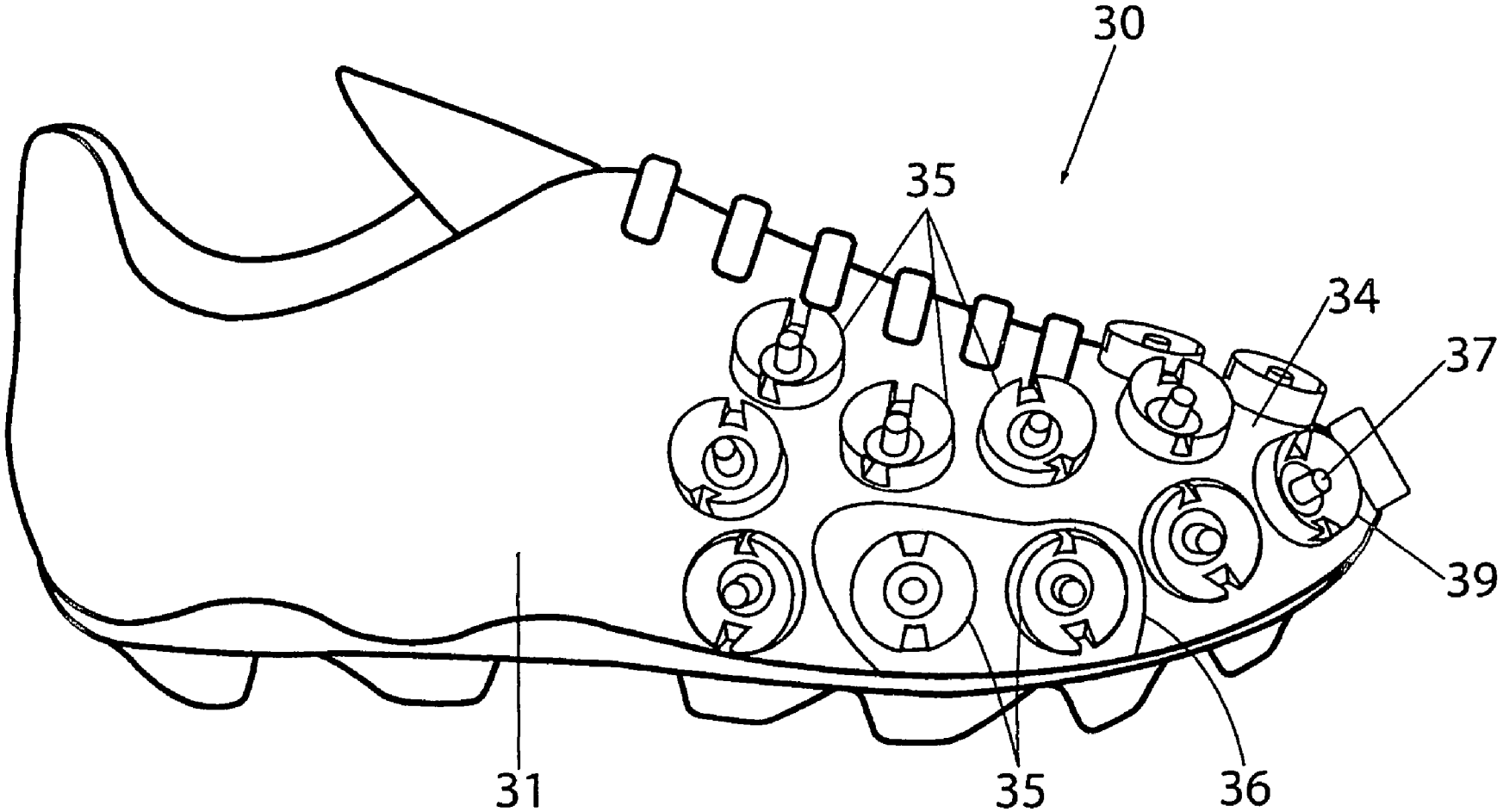
FIG. 4C is a side view of a variation of the shoe of FIG. 4B

FIG. 4C shows a further variation of the second embodiment, where at least one protrusion is provided to cover the sweet spot. In this variation, two protrusions 35 cover sweet spot 36.

Figure 5A:
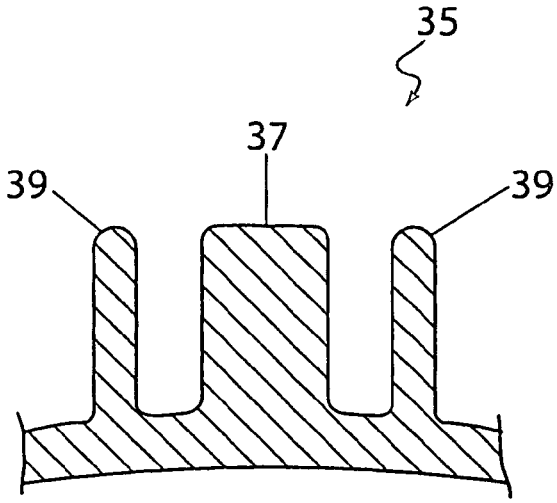
FIG. 5A is a cross-sectional view of the contoured shape portions of FIG. 4 in an initial state.
Figure 5B:
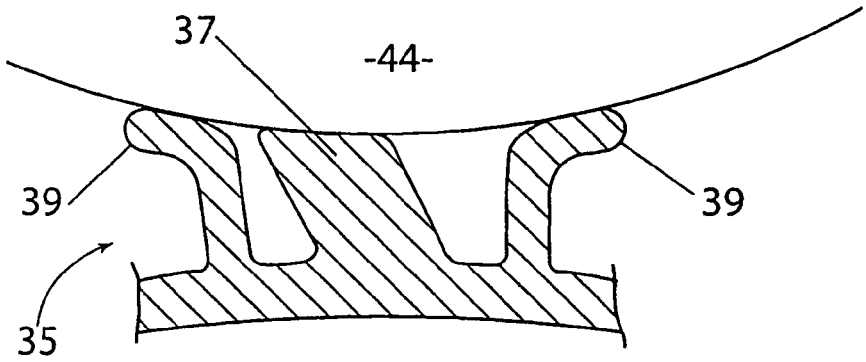
FIG. 5B is a cross-sectional view of the contoured shape portions of FIG. 4 in a deformed state in contact with a ball.

Referring to FIGS. 5A and 5B, the protrusions 35 of this second embodiment work in a similar manner to protrusions 15 of the first embodiment. FIG. 5A shows the inner peg 37 and outer ring 39 in their initial undeformed state. As with the first embodiment, the protrusions 35 are able to store and release energy. When the ball 44 contacts ball control region 34 of upper 31, protrusions 35 are deformed as shown in FIG. 5B. That is, peg 37 and outer ring 39 are deformed to produce the gloving effect as described above in relation to the first embodiment. Outer ring 39 deforms outwardly, while inner peg 37, being more resistant to deformation than outer ring 39, is deformed less than ring 39. Therefore, peg 37 is able to impart direct force to the ball 44 to increase the kicking power of shoe 30, as the ball 44 is redirected by peg 37 and ring 39 returning to the undeformed state of FIG. 5A.

Figure 5C:
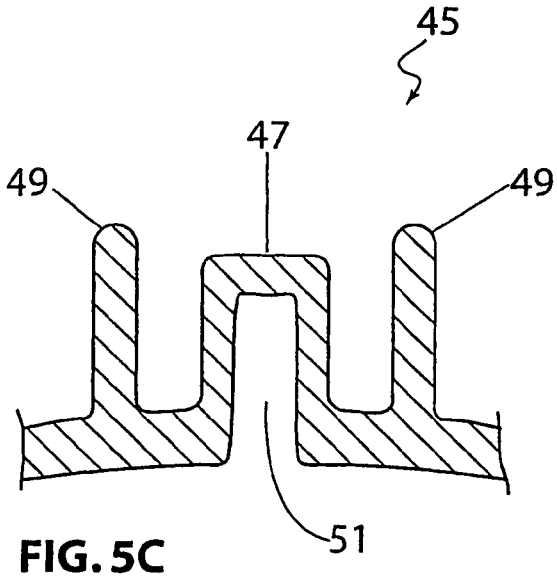
FIG. 5C is a cross-sectional view of a variation of the contoured shape portions of FIG. 5A.

In variation of the second embodiment, peg 37 may include an internal cavity instead of being solid, so as to provide additional deformability while being more resilient than outer ring 39. Furthermore, such a peg reduces the weight of peg 37. As an example, and referring to FIG. 5C, protrusion 45 has inner peg 47 which is slightly lower in height than outer ring 49. Inner peg 47 is made by moulding protrusion 45 to include an open internal cavity 51.

While in the first and second embodiments, the contoured shape portions are in the form of rings or in the case of the inner contoured shape portion of the second embodiment, a peg, other types of shapes are within the scope of the invention. Referring to FIGS. 6A-6F, several variations of the shapes that can be used with respect to the first and second embodiments are illustrated. FIGS. 6A, 6B, 6C, and 6D respectively show protrusions made up of successive shapes forming a regular pattern having diamond (100), square (102), rectangular (104), and spiral (106, 108) contoured shape portions. Each of the contoured shape portions 100, 102, 104, and 106, 108 are generally identical with each other in the same protrusion.

Another possible shape is shown in FIG. 6E. The protrusion 120 is a continuous spiral formed by the spiral outer arc portions 124 substantially surrounding inner arc portion 122 of lesser radius so that the outer arc portions 124 are outwardly deformable relative to the inner arc portion 122 of the spiral to promote contact with the ball and enhance ball control via the glove effect. The outer arc portions 124 may be inwardly deformable relative to the inner arc portion 122. FIG. 5F shows another variation where two parallel spirals 126, 128 form the protrusion.

Different contoured shapes may be used in a single protrusion. In addition, individual contoured shape portions can be formed by defining an outline of the shape rather than being a continuous shape. Both of these variations are shown in combination in FIG. 6G. In the protrusion of FIG. 6G, a continuous rectangular inner contoured shape portion 132 is provided with a triangular outer contoured shape portion formed by elements 134*a*, 134*b* and another outer contoured shape portion 136 is made up of discrete elements 136*a*, 136*b*, 136*c*, 136*d*, etc to form a generally circular shape. Alternatively, individual contoured shape portions formed as a continuous shape may have one or more slits or cut outs to divide each contoured shape portion into discrete elements.

Figure 6H:
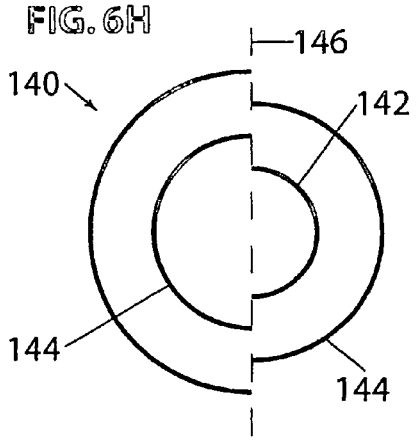
Figure 6I:
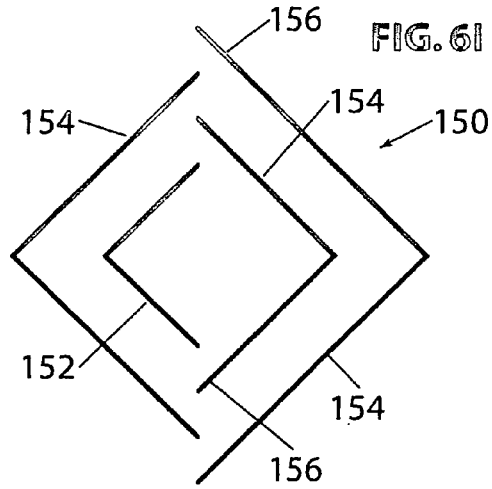

FIGS. 6H-6M illustrate other possible variations in the shapes formed by the contoured shape portions. In FIG. 6H, protrusion 140 has inner contoured shape portion 142 and successive outer contoured shape portions 144. Each of these contoured shape portions is formed as a semi-circle. The semi-circular contoured shape portions are positioned alternatively on either side of an imaginary center line 146. The positioning of the semi-circular contoured portions 142, 144 can be varied as required. Similarly, protrusion 150 in FIG. 6I has inner contoured shape portion 152 and alternating outer contoured shape portions 154, each being in the form of V-like shapes. In this embodiment, the edges 156 of outer contoured shape portions 154 may overlap each other as shown.

Figure 6J:
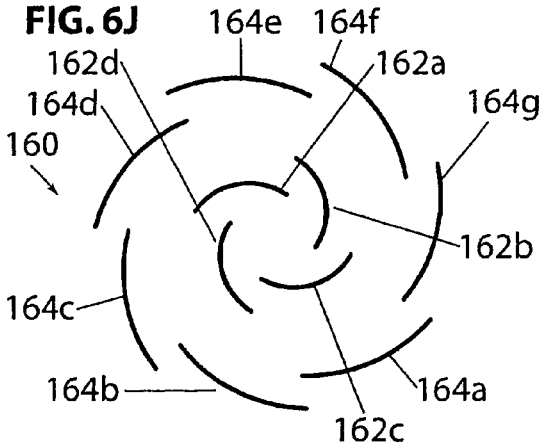
Figure 6K:
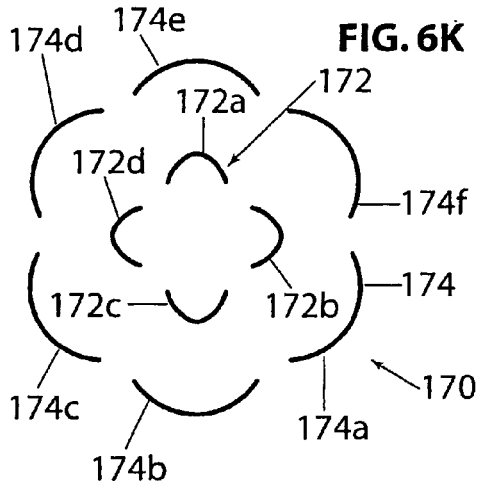

The protrusions 160 and 170 of FIGS. 6J and 6K, respectively, have contoured shape portions formed as the broken outline of shapes. In FIG. 6J, the individual elements 162*a*, 162*b*, 162*c*, 162*d* slightly overlap each other, as do the elements 164*a*-164*g* of the outer contoured shape portion. In FIG. 6K, the inner contoured shape portion 172 and outer contoured shape portion 174 form flower-like shapes in protrusion 170. Each "petal" or element 172*a*-172*d* in inner contoured shape portion 172 can be positioned in alignment with or offset to "petals" or elements 174*a*-174*f* in outer contoured shape portion 174.

Figure 6L:
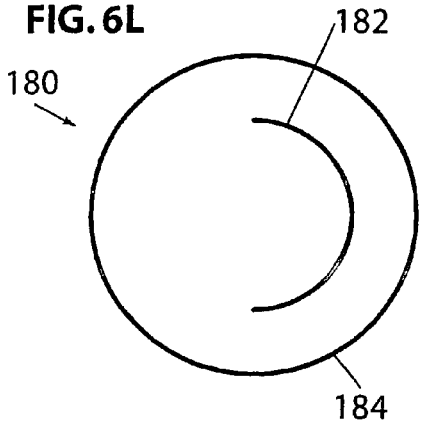
Figure 6M:
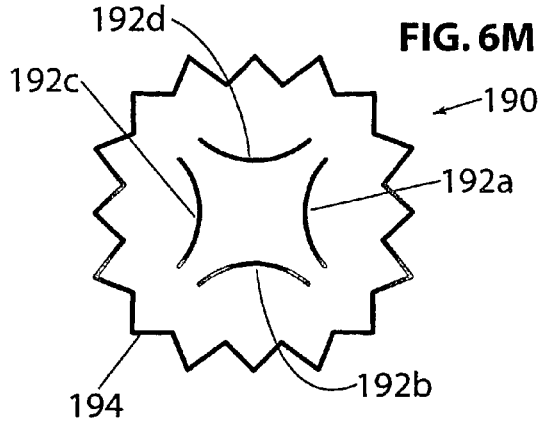

FIGS. 6L and 6M show combinations of different shapes in the one protrusion. Protrusion 180 has an inner contoured shape portion 182 in the form of a semi-circle and an outer contoured shape portion 184 in the form of a closed circle. Protrusion 190 has an inner contoured shape portion 192 composed of concave elements 192*a*-192*d* facing outwards, and an outer contoured shape portion 194 being in the form of a continuous sinusoidal or corrugated shape.

Another preferred embodiment of the invention is shown in FIG. 7A. The protrusion 200 has an inner contoured shape portion 202 and outer contoured shape portions 202, each forming continuous shapes. In adverse playing conditions, such as when it is raining or the field is muddy, debris such as mud, soil, and/or water can be trapped inside inner contoured shape portion 202 and between the contoured shape portions 202, 204. Therefore, in this embodiment a series of openings 206 are formed in the walls of each contoured shape portion to permit debris to escape from the contoured shape portions and protrusion 200. Thus, the protrusion 200 has a self-cleaning mechanism so that the protrusion 200 is able to provide enhanced ball control without being inhibited by debris clogging the contoured shape portions and otherwise hampering the functioning of the contoured shape portions. As illustrated in FIG. 7B, the openings 206 can be any geometrical or polygonal shape, such as rectangular 206*a*, circular 206*b*, triangular 206*c*, semi-circular 206*d*, etc. In addition, the openings 206 are positioned at the base of the contoured shape portion to enhance the escape of debris from the contoured shape portions 202, 204. However, other locations for openings 206 are possible, such as within the contoured shape portion to form an aperture therein (208 in FIG. 7C) or being spaced from the base and near the top of the contoured shape portion (210, 212 in FIG. 7C). Furthermore, individual openings 210, 212, 214 can have varying depths, as shown in FIG. 7C.

Moreover, the openings can be aligned with corresponding openings in other adjacent contoured shape portions so that a channel can be formed from the inner contoured shape portion to the outer contoured shape portions, as shown in FIG. 7A. The dotted lines 213 indicate the path of the channels formed by openings 206 in the protrusion 200.

A similar self-cleaning mechanism can be also provided where the contoured shape portions form broken outlines of shapes in the protrusion. As shown in FIG. 7D, protrusion 220 has an inner contoured shape portion 222 and contoured outer shape portions 224, each being made of contoured shape portion elements and each forming the broken outlines of circular shapes. The gaps 227 between the individual contoured shape portions 222, 224 are aligned with corresponding gaps in other contoured shape portions 224 so as to form channels 229 to facilitate the escape of debris such as soil, mud, and/or water from the protrusion 220. The gaps 227 need not be aligned with other gaps and can be offset relative to each other, as is shown in FIG. 7E.

In addition, the channels can be formed where contoured shape portions form differing continuous shapes or broken outlines of shapes or even a combination of continuous shapes and broken outlines of shapes. As is shown in FIG. 7F, a protrusion 240 has inner contoured shape portions 242 formed in the broken outline of a circle, followed by outer contoured shape portions 245 forming the broken outline of a rectangular shape and an outer contoured shape portion 196 forming a continuous circular shape. The continuous circular shape has openings 246 which are aligned with the gaps 247 between individual elements of contoured shape portions 224, 244 forming the broken outlines 242, 244 so as to form channels.

It is evident to a person skilled in the art that any of the features of the configurations above can be used separately. For example, the spirals in FIGS. 6D, 6E and 6F can be formed as an outline similar to that shown in FIG. 6G. Similarly, the protrusion shown in FIG. 6G can be made of contoured shape portions forming continuous rectangular, triangular, circular and geometrical shapes.

As another example, the second embodiment of FIG. 4A can also include the features of FIGS. 6A-6M and/or 7A-7F. The ring 39 may be substituted with a continuous shape or a broken outline shape such as those illustrated in FIGS. 6A-6M and may include openings or gaps as illustrated in FIGS. 7A-7F, such as the slots 43 in ring 39 of FIG. 4B. For example, a solid inner peg can be provided at the center of protrusion 140 in FIG. 6H with "inner" contoured shape portion 142 in effect of becoming another outer contoured shape portion. Similarly, solid inner pegs can be added to the protrusions in FIGS. 6A-6M. Again, successive outer contoured shape portions can be provided.

Figure 8A:
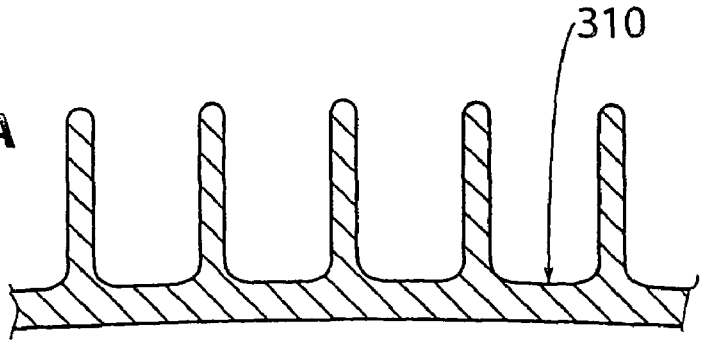
FIGS. 8A-8D are cross-sectional views of the contoured shape portions having different cross-sectional profiles.
Figure 8B:
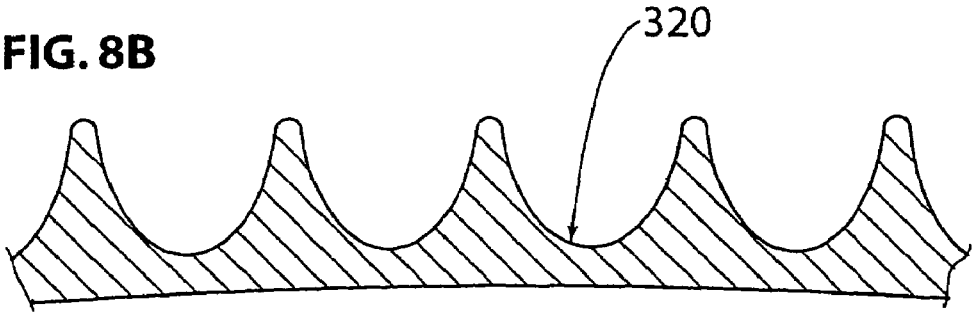
Figure 8C:
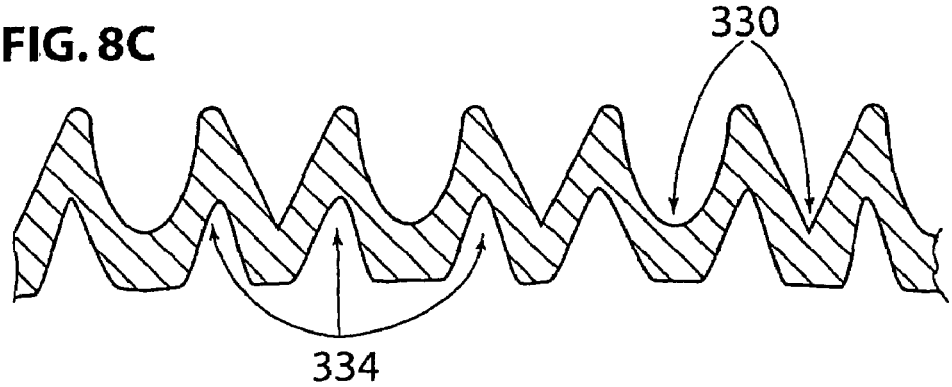
Figure 8D:
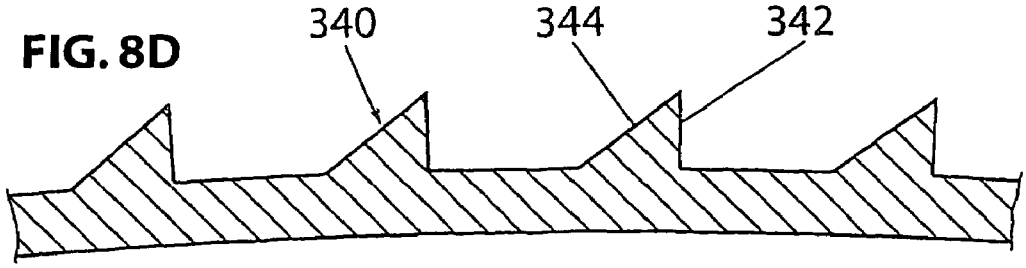

FIGS. 8A-8D illustrate various cross-sectional profiles for the contoured shape portions. The contoured shape portions may have a rectangular or square-like cross-sectional profile (310 in FIG. 8A), a sinusoidal profile forming U-shaped troughs (320 in FIG. 8B), a combination of alternating profiles forming alternating U-shaped and V-shaped troughs (330 in FIG. 8C), or a triangular or saw-tooth profile 340 (FIG. 8D). The triangular profile 340 illustrated in FIG. 8D has a substantially perpendicular side 342 and an inclined side 344. The inclined side 344 can face towards or away from the inner contoured shape portions The triangular profile 340 enhances the deformability of the contoured shape portions. The outer contoured shape portions of the embodiments of FIGS. 4A, 4B, 11 and 12 have the triangular profile of FIG. 8D. It is also possible to have a combination of or alternating rectangular/square like, sinusoidal, triangular, or other geometrical cross-sectional profiles. The type of cross-sectional profile selected will affect the deformability of the contoured shape portions and hence the "grip" and feel produced as well as the weight of the shoe. For example, in FIG. 8C cavities 334 can be formed (for example by injection moulding) to increase deformability and reduce weight.

Figure 9:
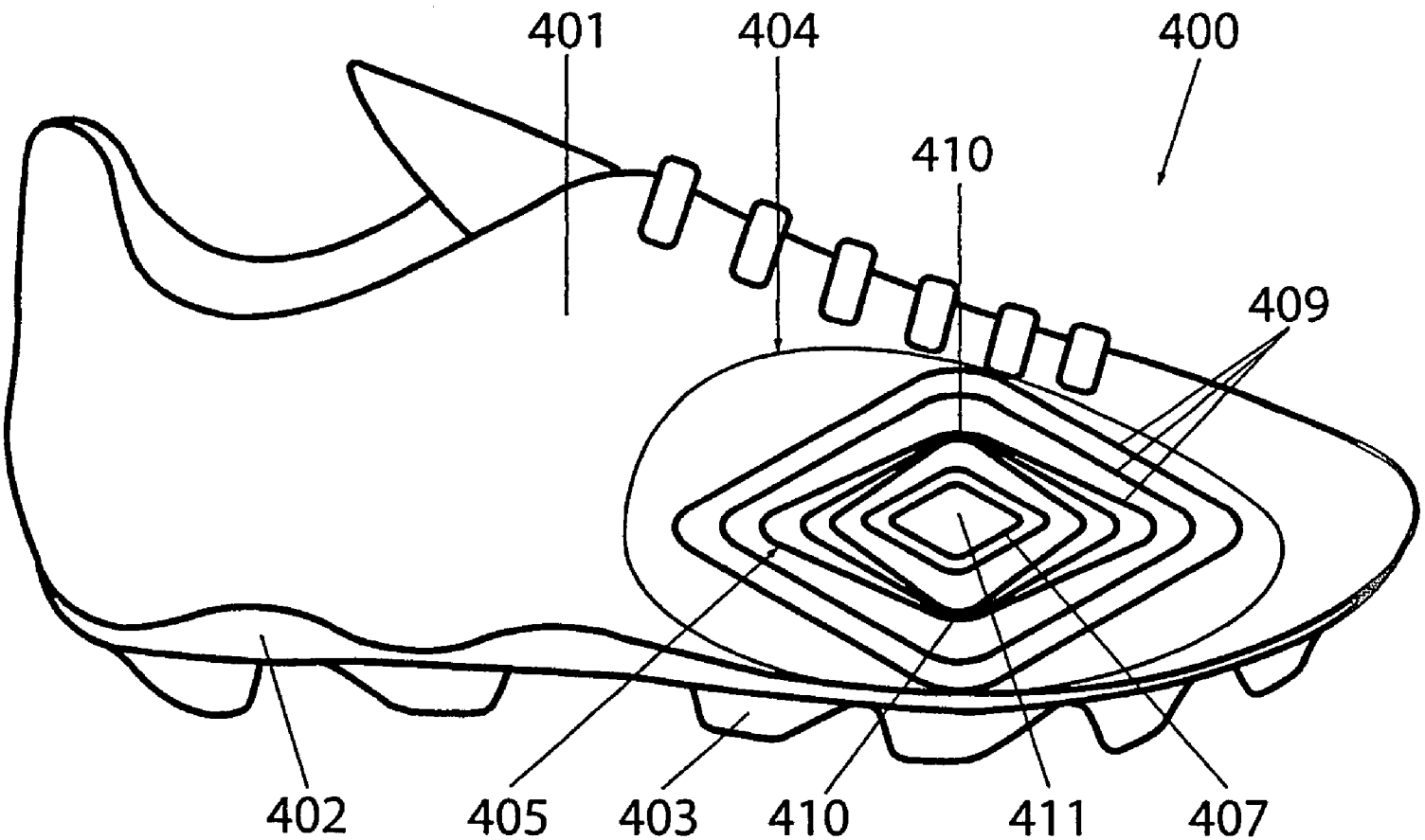
FIG. 9 is a side view of a further embodiment of a shoe in accordance with the present invention.
Figure 10:
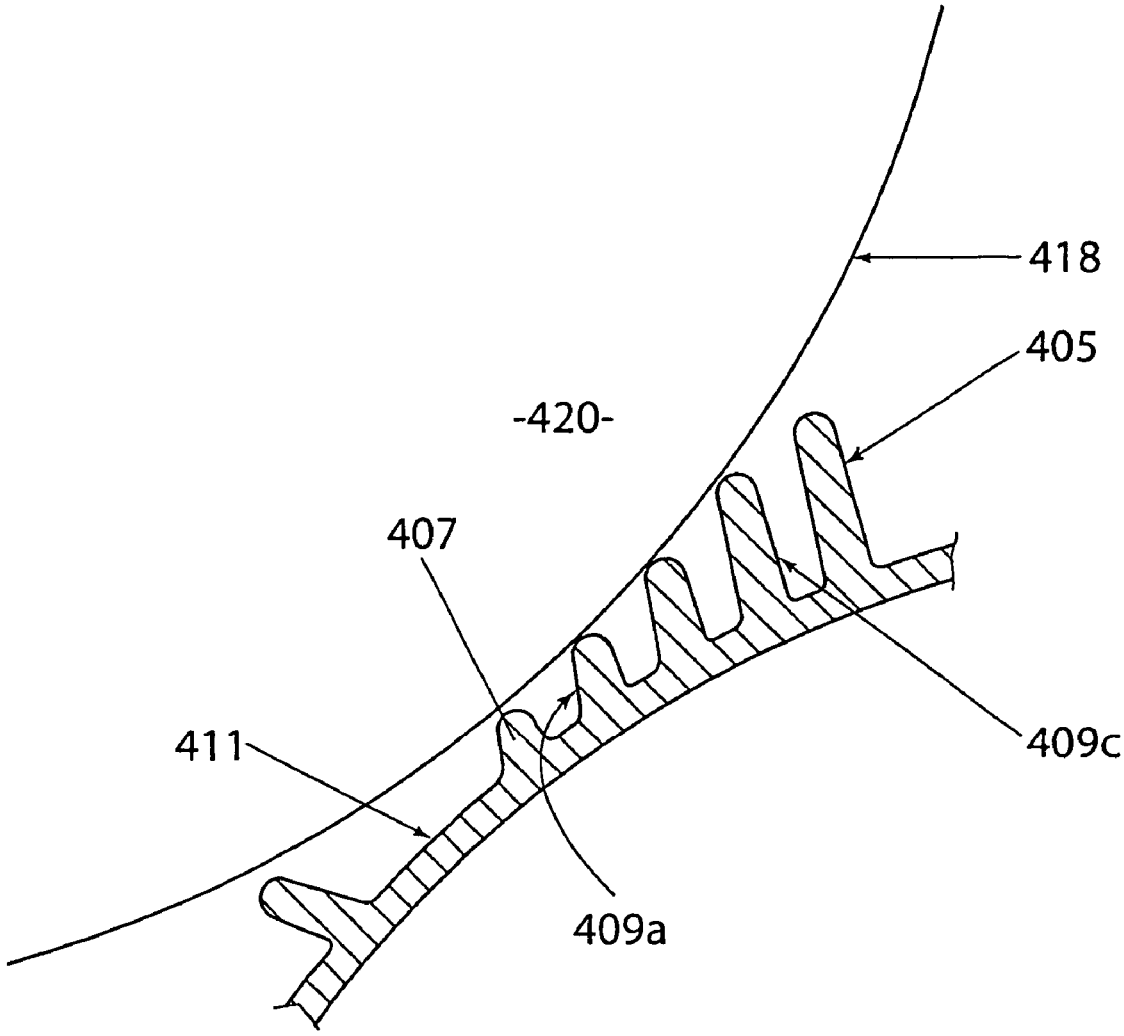
FIG. 10 is a cross-sectional view of the contoured shape portions of FIG. 9.

FIGS. 9 and 10 show another embodiment of the present invention. Football shoe 400 has an upper 401 and sole 402 provided with studs 403. Ball control surface 404 is attached or bonded to upper 401 and includes a plurality of protrusions 405. Each protrusion 405 has an inner contoured shape portion 407 in the form of a ring that is bounded by generally concentric outer contoured shape portions 409 forming successive outer rings similar to that shown in FIGS. 6A-6C. The outer rings 409 are spaced apart at different distances from inner ring 407 and some of the outer rings 409 have a common wall, as indicated at 410 in FIG. 9, creating a fingerprint-like pattern. The protrusions 405 having this fingerprint-like pattern can be located at the medial and/or lateral regions (protrusion 405 in FIG. 9 is illustrated in a lateral region of shoe 400). The protrusion 405 in the lateral region of shoe 400 has outer rings 409 generally concentric to the inner ring 407 and to each other. Alternatively, the rings 409 can be off centred.

A "sweet spot" area 411 is defined by inner ring 407. The sweet spot area 411 in this embodiment is generally convex in shape. As shown in a cross-sectional view in FIG. 10, the contoured shape portions 407, 409 have different heights so that outer shape portions 409*a* near the sweet spot area 411 (and inner shape portion 407) are of shorter height than outer shape portions 409*c* spaced further away, the outer shape portions 409*c* becoming progressively higher as they move away from the sweet spot area 411. This allows for the inner and outer contoured shape portions 407, 409 to accommodate the curved surface 418 of the ball 420 and promote contact with sweet spot area 411. In the previously described embodiments, except for FIG. 5C, the contoured shape portions had similar heights.

The concentric contoured shape portions 407, 409 of ball control surface 404 are each formed of a single compound, such as rubber or a suitable synthetic or fabric. However, as discussed generally above, the compound, height, spacing, angle of inclination and thickness of the concentric contoured shape portions 407,409 may vary on the football shoe upper 401.

Figure 11:
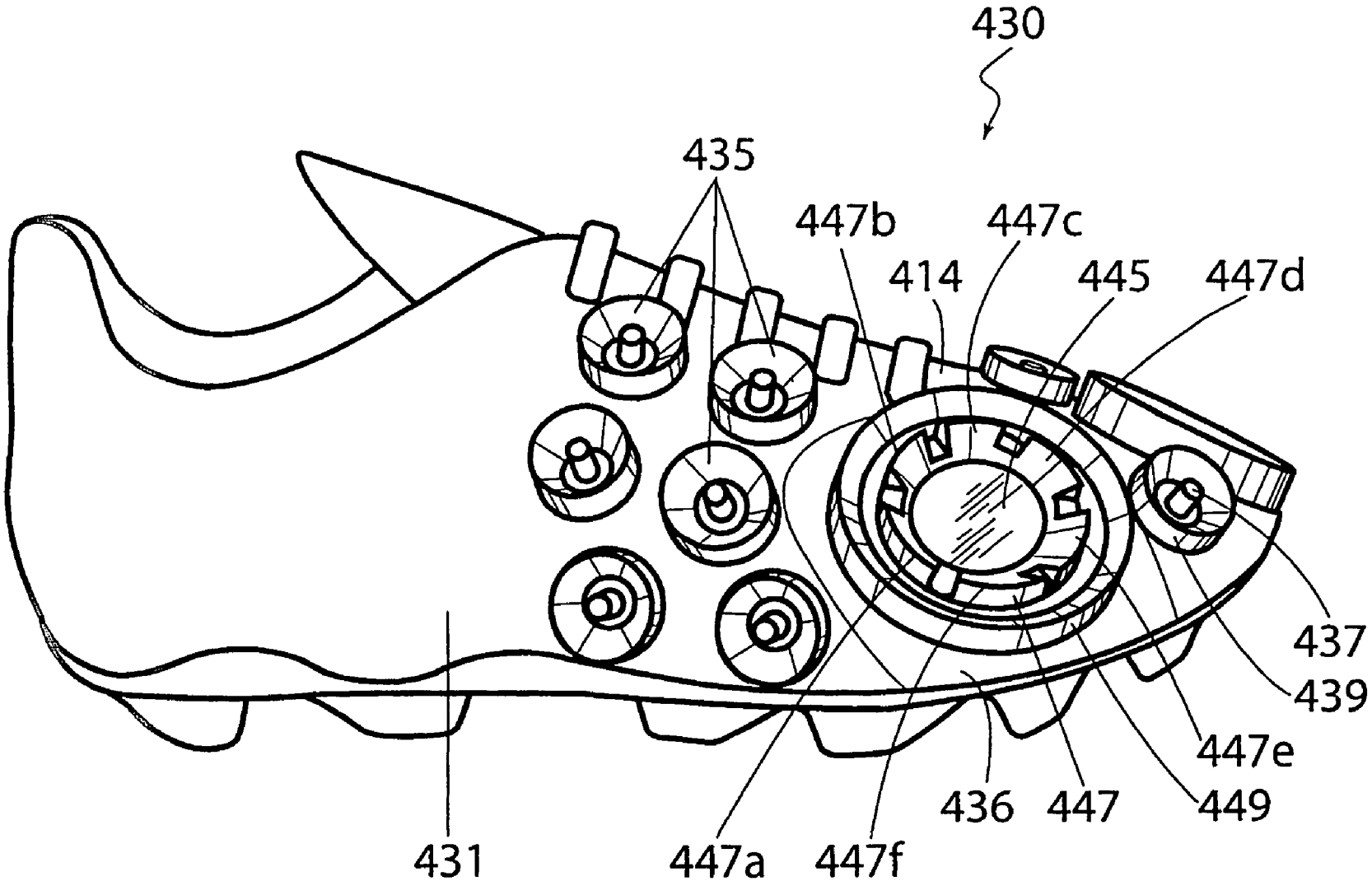
FIG. 11 is a side view of another embodiment of the present invention.

Alternatively, the sweet spot area can be covered by a single protrusion. Referring to FIG. 11, the shoe 430 with upper 431 has protrusions 435 with an additional single protrusion 445. The protrusions 435 are the same as protrusions 35 of the FIG. 4A embodiment, with an inner peg 437 and outer ring 439. Protrusion 445 is formed by an inner ring 447, made up of discrete elements 447*a*, 447*b*, 447*c*, 447*d*, 447*e*, 447*f* to form the outline of a ring, and an outer ring 449 which is continuous in shape.

Figure 12:
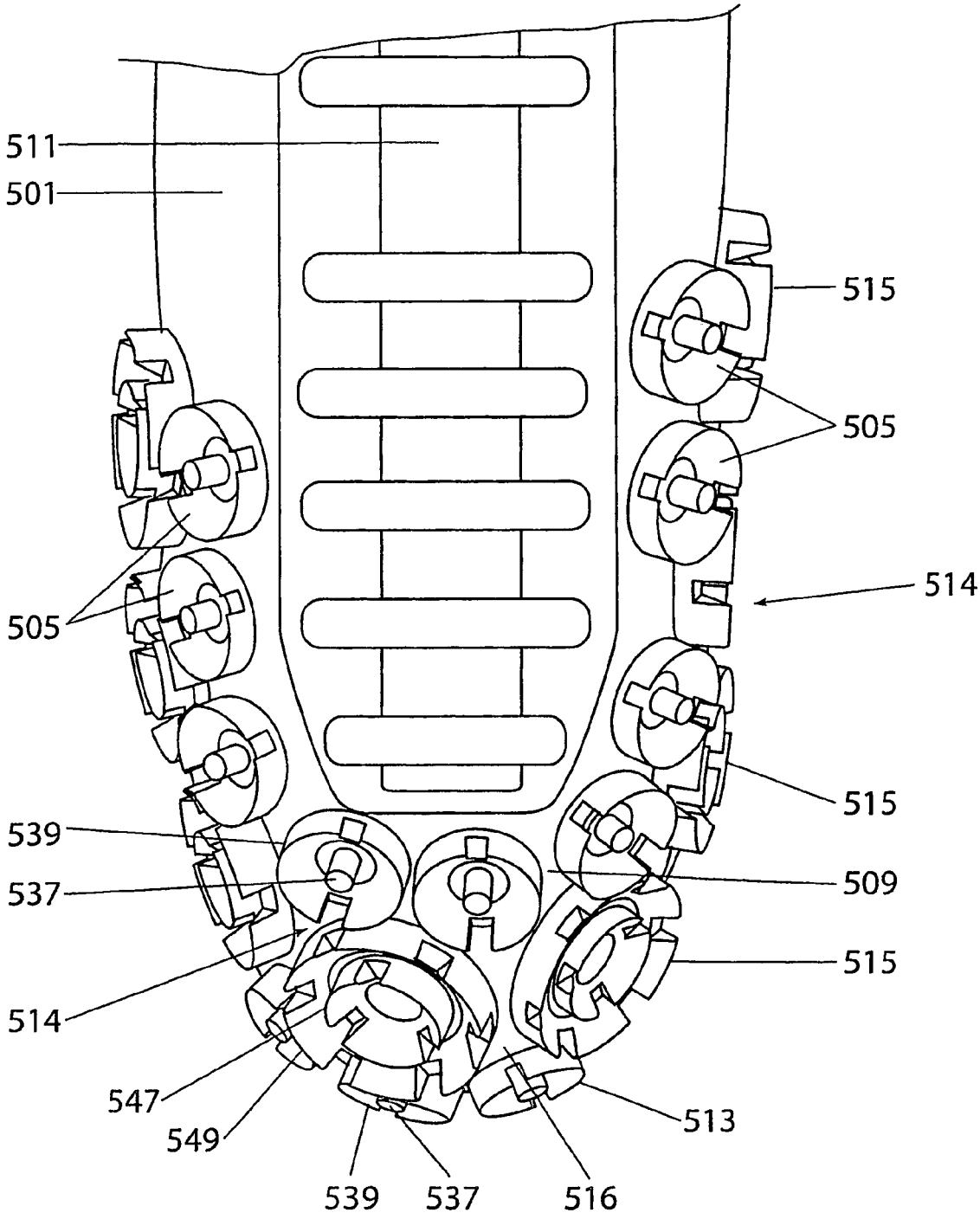
FIG. 12 is a partial top view of an alternative embodiment of the invention.

In another embodiment shown in FIG. 12, protrusions 505 are in a throat region 509 adjacent the shoe fastening portion 511, and at an end toe region 513, which are more resilient and less deformable than the protrusions 515 which cover the lateral 514 and medial 516 regions of the upper 501. The less deformable protrusion 505 (which have an inner peg 537 and outer ring 539) in throat region 509 and end toe region 513 gives extra power when ball contact occurs within these regions of the shoe (such as in kicking the ball). In contrast, the protrusions 515 (which have an inner ring 547 and an outer ring 549) in the lateral regions 514 and medial region 516 of ball control surface 514 are more deformable to give the player ball feel and grip. Several protrusions 515 are located in the medial and lateral regions. The protrusions in these embodiments can also be arranged to expose the "sweet spots " of the shoe upper 501.

Experiments were conducted on shoes made in accordance with embodiments of the invention and a conventional shoe. Two different tests were performed, an accuracy test and a curvature test. In each test a goal was set up, which was partially obstructed by a wall spaced about 9 m from the goal. The wall extended parallel to the goal and offset past one goal post. The wall was designed to simulate a line of defenders, as would occur in a football (or soccer) game. A soccer ball was placed in front of the wall about 10 m from the wall (about 19 m from goal face) and kicks were taken with each shoe by a number of players, and shoes being randomly alternated amongst each player.

In the accuracy experiment, a target area was selected as a 0.5 m×0.5 m square at the top comer of the goal face at the end of the goal post covered by the wall. It was found that shoes made in accordance with the embodiments of the invention outperformed the conventional shoe. On average, kicks taken with shoes in accordance with preferred embodiments of the invention resulted in balls that landed within the target area and towards the centre of the target area. In contrast, on average, kicks from the conventional shoe resulted in the balls that landed outside the target area.

In the curvature test, the players were required to kick the ball so as to curve the ball around the end of the wall extending past the goal post and into the goal face. It was found that shoes made in accordance with preferred embodiments of the invention outperformed the conventional shoe in the amount of curvature generated.

Furthermore, it was discovered from both tests that shoes made in accordance with preferred embodiments of the invention produced kicks that were overall more consistent than kicks taken with the conventional shoe.

Thus, shoes made in accordance with embodiments of the invention provided greater control in terms of accuracy, curvature and consistency of the ball than conventional shoe. Consequently, balls kicked by shoes in accordance with embodiments of the invention tend to hit a target area (for example a section of a goal face or a foot of a team member) in a tighter band and so provide more reliable results.

Figure 13:
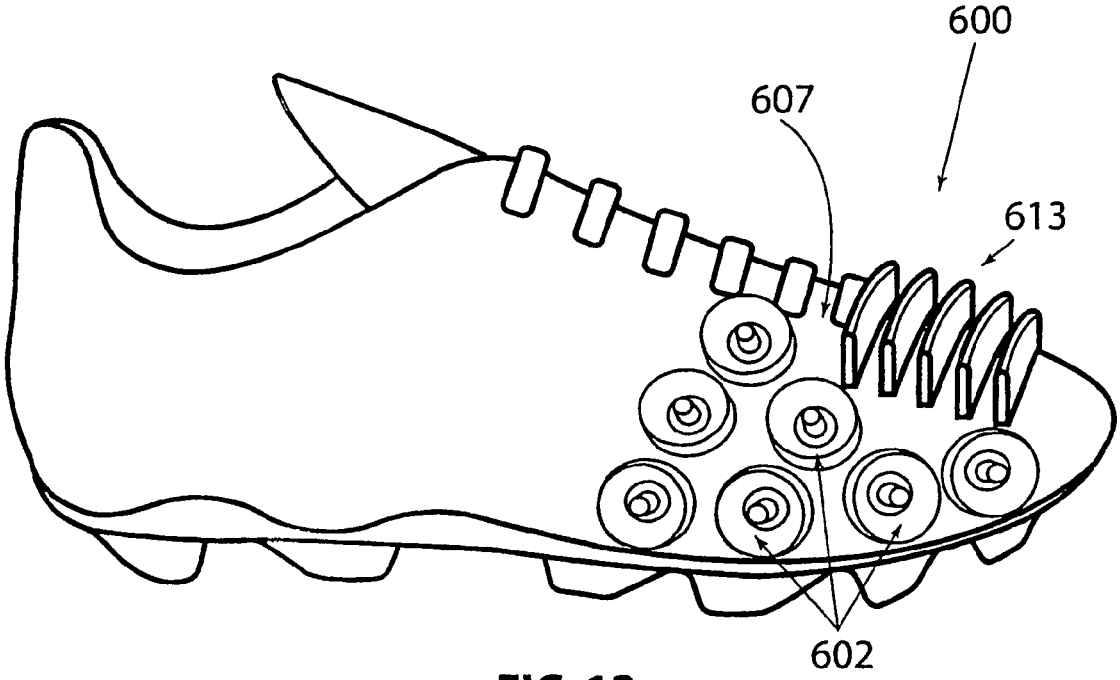
FIG. 13 is a side view of further embodiment of the present invention.
Figure 14:
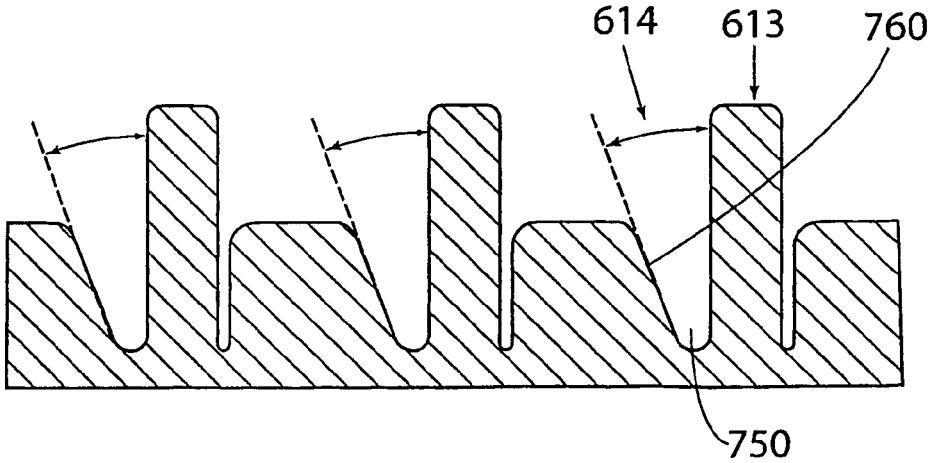
FIG. 14 is a cross-sectional view of the bar-like members of FIG. 13 in an initial state.
Figure 15:
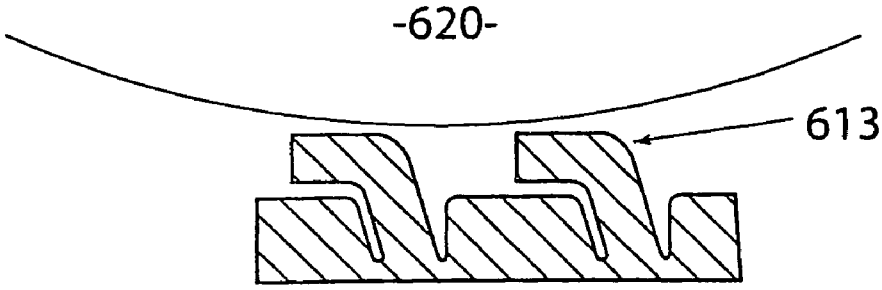
FIG. 15 is a cross-sectional view of the bar-like members of FIG. 13 in a deformed state in contact with a ball.

FIG. 13 is a side view of a football shoe 600 in accordance with another embodiment of the present invention. The shoe 600 has protrusions 602 which function the same as protrusions of FIG. 4A. In this embodiment, shoe 600 includes a throat region 607 having resiliently deformable bar-like members or ridges 613 which extend transversely across the throat region 607. An inclined V-shaped groove 750 is provided so as to form an inclined support surface 760 for ridges 613, as shown in FIG. 14. The groove 750 and supporting surface 760 assist in increasing the amount of deformation of the ridge 613 and so enhance the amount of force than can be applied to ball 620 upon contact. As shown in FIG. 15, the ridges 613 deform to a greater extent than usual along arc 614 (shown in FIG. 14) due to the space provided by groove 750. The supporting surface 760 provides added resilience to the ridge 613 so that upon contact with the ball 620, the ridge 613 is able to apply more force to the ball in addition to the stored energy from the increased amount of deformation of ridge 613 due to groove 750, thus resulting in greater kicking power and ball velocity.

Figure 16:
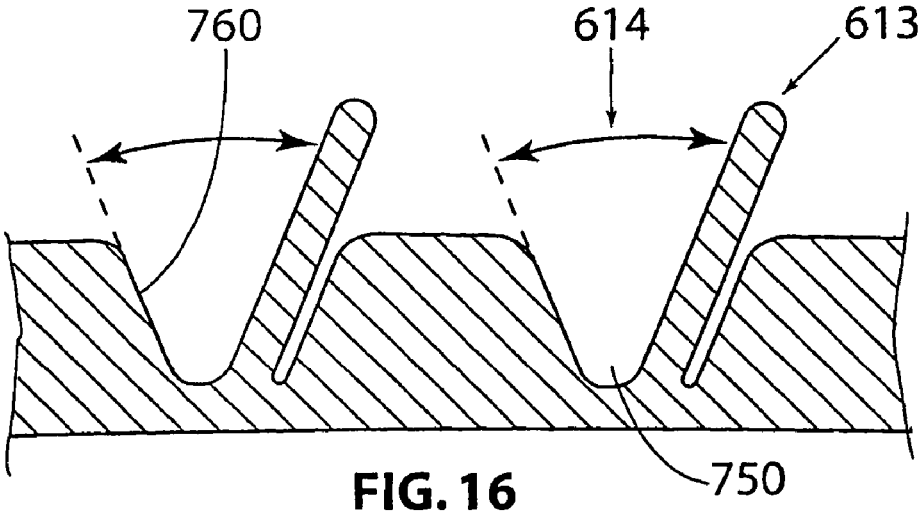
FIG. 16 is a cross-sectional view of an alternative embodiment of the bar-like members of FIG. 13 in an initial state.

In a variation, the ridges 613 may be inclined forward towards the toe as shown in FIG. 16 to further increase the arc of deformation 614 of protrusion 613, thereby storing and releasing a higher level of energy and apply more force to the ball.

Figure 17:
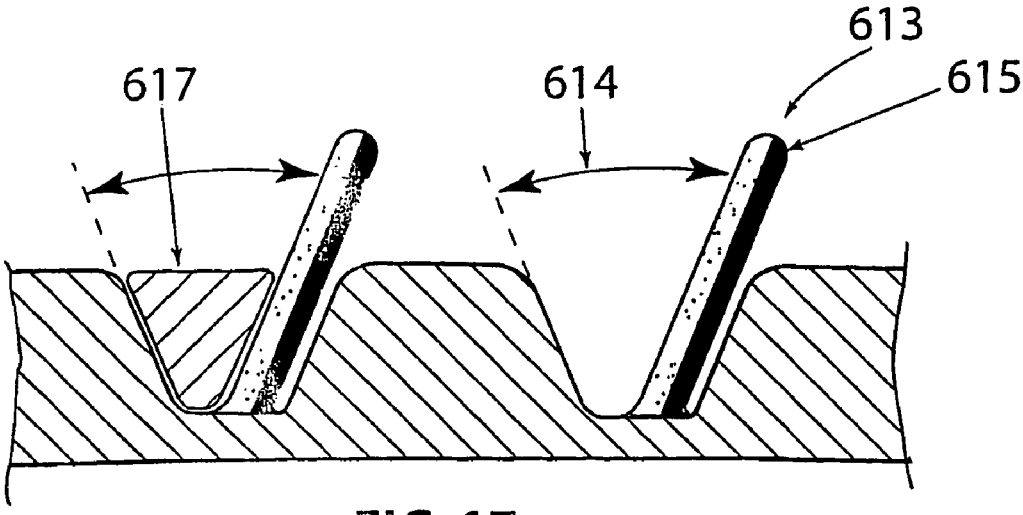
FIG. 17 is a cross-sectional view of a further alternative embodiment of the bar-like members of FIG. 13 in an initial state.

Another variation is illustrated in FIG. 17. In this embodiment, the ridges 613 have a harder and more resilient layer of material 615 in the ball facing contact part of the ridge 613.

This added resilience to ridge 613 means more force is required to deform ridge 613 and so increased power can be supplied to the ball. In addition, a supporting pad made of elastic rubber, which is filled with a resilient gel, or air filled void, 617 may be provided in groove 650 to enhance the amount of energy stored and transferred to ball 612. Alternatively, a deformable resilient member or spring-like mechanism can be used to support the ridge 613. Both the resilient strip 615 and the supporting pad 617 can be used separately, rather than together as shown in FIG. 18.

It should be noted that the groove 750, resilient strip 615 and supporting pad 617 (or spring-like mechanism) are individually applicable to all previous embodiments in the first aspect of the invention as illustrated in the previous Figures. That is, individual contoured shape portions may utilise a groove, resilient strip and/or supporting pad (or spring-like mechanism).

In another aspect of the invention, one or more of the protrusions or one or more the contoured shape portions may be removably attachable to the upper and available in a kit for assembly to modify a conventional shoe. The protrusion(s) or the contoured shape portion(s) can be fixed or removably attached to a mounting surface, the mounting surface being removably attachable to the shoe upper. In another example, the ball control surface could be attached with snaps, a hook and pile fastener or in any other convenient manner. For example, the ball control surface can be rolled onto an existing shoe upper like a removable skin. Individual contoured shape portions might also be replaceable so that an individual football player may tailor their ball control region to suit their individual needs or desires.

Alternatively, the shoe upper and either the ball control surface, the protrusion(s) or one or more of the contoured shape portions, can be integrally moulded with the sole.

While various embodiments of the present invention have been described above, it should be understood that they have been presented by way of example, and not limitation. In particular, while the above embodiments have been described as having outer shape portions deformable radially outward relative to the inner shape portion, the scope of the invention includes the embodiments of like structure where the outer shape portions are deformable radially inward or where both the inner and outer shape portions are deformable. It will be apparent to persons skilled in the relevant art that various changes in form and detail can be made therein without departing from the spirit and scope of the invention. Thus the present invention should not be limited by any of the above-described exemplary embodiments.

The claims defining the invention are as follows:

1. A shoe upper, comprising:

one or more resiliently deformable protrusions extending from an outer surface of the shoe upper and positioned for contact with a ball, where each protrusion includes at least an inner contoured shape portion and an outer contoured shape portion each extending from the outer surface of the shoe upper, and where the outer contoured shape portion is deformable so as to promote engagement of the protrusion with the ball, and wherein the inner and outer contoured shape portions of one or more protrusions in a throat region of the shoe upper are less deformable than the contoured shape portions of one or more protrusions in a lateral region or medial region of the shoe upper.

2. A shoe upper as claimed in claim 1, in which at least one protrusion comprises two or more outer contoured shape portions arranged so as to radiate outwardly relative to the inner contoured shape, and where:

the outer contoured shaped portion nearest the inner contoured shape portion in the arrangement bounds the inner contoured shape portion; and each successive outer contoured shape portion bounds the preceding outer contoured shape portion.

3. A shoe upper according to claim 1, in which one or more of the outer contoured shape portions in any protrusion is deformable radially relative to the inner contoured shape portion.

4. A shoe upper according to claim 3, in which one or more of the outer contoured shape portions in any protrusion is deformable radially inward relative to the inner contoured shape portion.

5. A shoe upper according to claim 4, in which one or more of the outer contoured shape portions in any protrusion is deformable radially outward relative to the inner contoured shape portion.

6. A shoe upper according to claim 5, in which one or more of the outer contoured shape portions in any protrusion is inclined outward relative to the inner contoured shape portion, so as to promote radially outward deformation of the outer contoured shape portion when that portion comes into contact with the ball.

7. A shoe upper according to claim 1, in which the inner contoured shape portion is also able to contact the ball.

8. A shoe upper according to claim 7, in which the inner contoured shape portion is deformable:

inwardly; and/or outwardly relative to the outer contoured shape portion, upon the inner contoured shape portion coming into contact with the ball.

9. A shoe upper according to claim 2, in which, within any one protrusion, the contoured shape portions generally have the same shape.

10. A shoe upper according to claim 2, in which, within any one protrusion, the contoured shape portions generally have different shapes.

11. A shoe upper according to claim 2, in which the shape of the contoured shape portions is selected from the group consisting of:

Circular shapes;
Triangular shapes;
Rectangular shapes;
Square shapes;
Ovoid shapes;
Spiral shapes;
Diamond shapes;
Semi circular shapes;
V-like shapes;
Flower-like shapes; and
Other two-dimensional geometric shapes.

12. A shoe upper according to claim 11, in which the shape of one or more of the contoured shape portions in any one protrusion is formed as a continuous shape.

13. A kit for a shoe upper, the kit comprising:

one or more resiliently deformable protrusions, in which each protrusion includes at least an inner contoured shape portion and an outer contoured shape portion, and where the outer contoured shape portion is deformable so as to promote engagement of the protrusion with the ball; and a mounting surface for attaching one or more of the protrusions to the shoe upper so that when attached, the one or more protrusions extend from an outer surface of the shoe upper, and are positioned for contact with a ball, and wherein the inner and outer contoured shape portions of one or more protrusions in a throat region of the shoe upper are less deformable than the contoured shape portions of one or more protrusions in a lateral region or medial region of the shoe upper.

14. A shoe upper according to claim 11, in which the shape of one or more of the contoured shape portions in any one protrusion is formed as a discontinuous shape.

15. A shoe upper according to claim 12, in which one or more of the contoured shape portions in any one protrusion have one or more openings which are aligned.

16. A shoe upper according to claim 15, in which one or more of the openings of one or more of the contoured shape portions in any one protrusion are formed at least as an aperture.

17. A shoe upper according to claim 12, in which one or more of the contoured shape portions in any one protrusion have one or more openings which are offset.

18. A shoe upper according to claim 17, in which one or more of the openings of one or more of the contoured shape portions in any one protrusion are formed at least as an aperture.

19. A shoe upper according to claim 7, in which the inner contoured shape portion is solid.

20. A shoe upper according to claim 12, in which the cross-sectional profile of one or more of the contoured shape portions is at least one of a rectangular profile, a sinusoidal profile, a triangular profile, an arcuate profile, or any other two-dimensional geometric profile.

21. A shoe upper according to claim 1, in which the inner and outer contoured shape portions in any one protrusion are made from at least one of rubber, plastic, carbon fiber, fabric, resin, polyurethane, a synthetic material, or any combination of such materials.

22. A shoe upper according to claim 1, in which the inner and outer contoured shape portions in any one protrusion have varying heights relative to each other.

* * * * *